US008378203B2

(12) United States Patent
Wallace et al.

(10) Patent No.: US 8,378,203 B2
(45) Date of Patent: Feb. 19, 2013

(54) SIMULATED PERCUSSION INSTRUMENT

(75) Inventors: Michael Wallace, Vancouver, WA (US); Philip T. Odom, Vancouver, WA (US)

(73) Assignee: Pure Imagination, LLC, Vancouver, WA (US)

( * ) Notice: Subject to any disclaimer, the term of this patent is extended or adjusted under 35 U.S.C. 154(b) by 21 days.

(21) Appl. No.: 13/192,257

(22) Filed: Jul. 27, 2011

(65) Prior Publication Data

US 2012/0024132 A1 Feb. 2, 2012

Related U.S. Application Data

(60) Provisional application No. 61/368,235, filed on Jul. 27, 2010.

(51) Int. Cl.
*G10H 3/10* (2006.01)

(52) U.S. Cl. ..... 84/733

(58) Field of Classification Search ..... 324/457, 324/658, 686; 340/686.6; 345/173; 84/689, 84/723, 733
See application file for complete search history.

(56) References Cited

U.S. PATENT DOCUMENTS

| | | | | |
|---|---|---|---|---|
| 4,213,367 | A * | 7/1980 | Moog | 84/689 |
| 4,299,041 | A | 11/1981 | Wilson | |
| 4,852,443 | A * | 8/1989 | Duncan et al. | 84/733 |
| 5,129,654 | A | 7/1992 | Bogner | |
| 5,188,368 | A | 2/1993 | Ryan | |
| 5,413,518 | A | 5/1995 | Lin | |
| 5,538,430 | A | 7/1996 | Smith | |
| 5,645,432 | A | 7/1997 | Jessop | |
| 5,853,327 | A | 12/1998 | Gilboa | |
| 6,168,158 | B1 | 1/2001 | Bulsink | |
| 6,661,239 | B1 | 12/2003 | Ozick | |
| 6,819,316 | B2 | 11/2004 | Schulz | |
| 7,242,393 | B2 | 7/2007 | Caldwell | |
| 7,276,917 | B2 * | 10/2007 | Deangelis et al. | 324/661 |
| 7,301,351 | B2 * | 11/2007 | Deangelis et al. | 324/687 |
| 7,368,921 | B2 * | 5/2008 | Deangelis et al. | 324/661 |

(Continued)

FOREIGN PATENT DOCUMENTS

| | | | |
|---|---|---|---|
| JP | 2007-324088 | A | 12/2007 |
| KR | 10-2007-0032924 | A | 3/2007 |

(Continued)

OTHER PUBLICATIONS

Novacentrix, "MetalonTMConductiveInksforPrintedElectronics", http://www.novacentrix.com/images/downloads/InkBrochure2008revb.pdf, Apr. 11, 2009.

(Continued)

*Primary Examiner* — Jianchun Qin
(74) *Attorney, Agent, or Firm* — Rylander & Associates, PC; Philip R. M. Hunt; Kurt M. Rylander

(57) ABSTRACT

Embodiments of an electronic instrument simulating a percussion instrument using capacitive touch sensitive sensors are described herein. Embodiments described comprise an art layer, a sensor layer, a shielding layer, an electronics package and a speaker. The art layer has depictions of one or more percussion instruments. The sensor layer is deposed under the art layer. The sensor layer has one or more instrument sensors, each comprising one or more capacitive touch sensors. Instrument sensors are positioned underneath one of the depicted percussion instruments in the art layer so that a finger tapping the depicted instrument will trigger the sensor. The capacitive touch sensors are electrically connected to the electronics package configured to detect changes in capacitance when a particular capacitive touch sensor is touched, causing the electronics package to play on the speaker a sound sample of an percussion instrument associated with that capacitive touch sensor.

16 Claims, 14 Drawing Sheets

U.S. PATENT DOCUMENTS

| | | | | |
|---|---|---|---|---|
| 7,395,717 | B2 * | 7/2008 | DeAngelis et al. | 73/728 |
| 7,408,109 | B1 * | 8/2008 | Freitas | 84/723 |
| 7,439,962 | B2 | 10/2008 | Reynolds et al. | |
| 7,465,869 | B1 * | 12/2008 | Freitas | 84/723 |
| 7,477,242 | B2 | 1/2009 | Cross | |
| 7,578,195 | B2 * | 8/2009 | DeAngelis et al. | 73/718 |
| 7,737,953 | B2 | 6/2010 | Mackey | |
| 7,784,366 | B2 * | 8/2010 | Daverman et al. | 73/862.626 |
| 7,932,898 | B2 | 4/2011 | Philipp et al. | |
| 8,044,665 | B2 | 10/2011 | Joutsenoja et al. | |
| 2006/0038791 | A1 | 2/2006 | Mackey | |
| 2007/0031161 | A1 | 2/2007 | Iandoli | |
| 2007/0062739 | A1 | 3/2007 | Philipp et al. | |
| 2007/0229464 | A1 * | 10/2007 | Hotelling et al. | 345/173 |
| 2008/0236374 | A1 | 10/2008 | Kramer et al. | |
| 2008/0238433 | A1 | 10/2008 | Joutsenoja et al. | |
| 2008/0238448 | A1 | 10/2008 | Moore et al. | |
| 2008/0238706 | A1 | 10/2008 | Kenwright | |
| 2009/0260508 | A1 | 10/2009 | Elion | |
| 2009/0309303 | A1 | 12/2009 | Wallace et al. | |
| 2009/0315258 | A1 | 12/2009 | Wallace et al. | |
| 2010/0079153 | A1 | 4/2010 | Maloof et al. | |
| 2010/0117660 | A1 | 5/2010 | Douglas et al. | |
| 2010/0231555 | A1 | 9/2010 | Mackey | |
| 2010/0244809 | A1 | 9/2010 | Joutsenoja et al. | |
| 2010/0244810 | A1 | 9/2010 | Joutsenoja et al. | |
| 2011/0197333 | A1 * | 8/2011 | Liotta | 2/90 |
| 2011/0197334 | A1 * | 8/2011 | Liotta | 2/90 |
| 2011/0197742 | A1 * | 8/2011 | Liotta | 84/725 |
| 2011/0199333 | A1 | 8/2011 | Philipp et al. | |
| 2011/0308378 | A1 * | 12/2011 | Wallace et al. | 84/689 |
| 2012/0019475 | A1 | 1/2012 | Li et al. | |
| 2012/0024132 | A1 * | 2/2012 | Wallace et al. | 84/689 |

FOREIGN PATENT DOCUMENTS

| | | | |
|---|---|---|---|
| KR | 10-2007-007248 | A | 7/2007 |
| WO | 2011/143260 | A2 | 11/2011 |
| WO | 2011/160038 | A2 | 12/2011 |
| WO | 2012/015964 | A2 | 2/2012 |
| WO | 2012/116233 | A2 | 8/2012 |

OTHER PUBLICATIONS

Kim, Written Opinion of the International Searching Authority PCT/US2012/026401, Sep. 24, 2012, ISA/KR, Republic of Korea.

Jianchun Qin, Office Action on U.S. Appl. No. 13/163,401, mailed Sep. 18, 2012, USPTO, US.

Gary Paumen, Office Action on U.S. Appl. No. 13/104,878, mailed Oct. 16, 2012, USPTO, US.

Hwan, Written Opinion of the International Searching Authority PCT/US2011/035980, ISA/KR, Republic of Korea.

Lee, Written Opinion of the International Searching Authority PCT/US2011/040913, ISA/KR, Republic of Korea.

Lee, Written Opinion of the International Searching Authority PCT/US2011/045598, ISA/KR, Republic of Korea.

Kim, Written Opinion of the International Searching Authority PCT/US2012/026401, ISA/KR, Republic of Korea.

* cited by examiner

SIMULATED PERCUSSION INSTRUMENT

CROSS-REFERENCE TO RELATED APPLICATION

The present application claims the benefit of, and priority to, U.S. Provisional Application No. 61/368,235 filed on 27 Jul. 2010, incorporated herein by reference.

FIELD OF THE INVENTION

The present invention relates to the field of musical instruments. In particular, the present invention relates to electronic musical instruments that simulate percussion instruments.

BACKGROUND

A recent proliferation of inexpensive computer processors and logic devices has influenced games, toys, books, and the like. Some kinds of games, toys, and books use embedded sensors in conjunction with control logic coupled to audio and/or visual input/output logic to enrich the interactive experience provided by the game, toy, book, or the like. An example is a book or card (e.g., greeting card) that can sense the identity of an open page or card and provide auditory feedback to the reader relevant to the content of the open page or card.

One type of sensor used in games, toys and books is a capacitive touch sensor. A capacitive touch sensor typically is a small capacitor enclosed in an electrical insulator. The capacitor has an ability to store an electrical charge, referred to as capacitance. When a power source applies an increased voltage across the capacitor, electrical charges flow into the capacitor until the capacitor is charged to the increased voltage. Similarly, when the power source applies a decreased voltage the capacitor, electrical charges flow out of the capacitor until the capacitor is discharged to the decreased voltage. The amount of time it takes for the capacitor to charge or discharge is dependent on the change in voltage applied and the capacitance of the capacitor. If the capacitance is unknown, it can be calculated from the charge or discharge time and the change in voltage applied. A person touching or coming close to a capacitive touch sensor can change the sensor's effective capacitance by combining the person's capacitance with the capacitance of the capacitive touch sensor. This change in effective capacitance can be detected by a change in the charge or discharge times.

Most common capacitive touch sensors, such as those used in cell phones and ATMs are made on inflexible substrates several millimeters thick and protected by glass. Thin film capacitive touch sensors are known, such as those taught in U.S. Pat. No. 6,819,316 "Flexible capacitive touch sensor." However, thin film capacitive touch sensors are not used much. One reason is that thin film capacitive touch sensors can exhibit a "two-sided" effect that makes thin film capacitive touch sensors sensitive to touch on both sides of the sensor.

A number of prior art patents have described games (e.g., board games), toys, books, and cards that utilize computers and sensors to detect human interaction. The following represents a list of known related art:

| Reference: | Issued to: | Date of Issue/ Publication: |
|---|---|---|
| U.S. Pat. No. 5,645,432 | Jessop | Jul. 8, 1997 |
| U.S. Pat. No. 5,538,430 | Smith et al. | Jul. 23, 1996 |
| U.S. Pat. No. 4,299,041 | Wilson | Nov. 10, 1981 |
| U.S. Pat. No. 6,955,603 | Jeffway, Jr. et al | Oct. 18, 2005 |
| U.S. Pat. No. 6,168,158 | Bulsink | Jan. 2, 2001 |
| U.S. Pat. No. 5,853,327 | Gilboa | Dec. 29, 1998 |
| U.S. Pat. No. 5,413,518 | Lin | May 9, 1995 |
| U.S. Pat. No. 5,188,368 | Ryan | Feb. 23, 1993 |
| U.S. Pat. No. 5,129,654 | Bogner | Jul. 14, 1992 |

The teachings of each of the above-listed citations (which does not itself incorporate essential material by reference) are herein incorporated by reference. None of the above inventions and patents, taken either singularly or in combination, is seen to describe an embodiment or embodiments of the instant invention described below and claimed herein.

For example, U.S. Pat. No. 5,853,327 "Computerized Game Board" describes a system that automatically senses the position of toy figures relative to a game board and thereby supplies input to a computerized game system. The system requires that each game piece to be sensed incorporate a transponder, which receives an excitatory electromagnetic signal from a signal generator and produces a response signal that is detected by one or more sensors embedded in the game board. The complexity and cost of such a system make it impractical for low-cost games and toys.

U.S. Pat. No. 5,129,654 "Electronic Game Apparatus," U.S. Pat. No. 5,188,368 "Electronic Game Apparatus," and U.S. Pat. No. 6,168,158 "Device for Detecting Playing Pieces on a Board" all describe systems using resonance frequency sensing to determine the position and/or identity of a game piece. The system requires a resonator coil in each unique game piece, which increases the complexity and cost of the system while reducing the flexibility of use.

U.S. Pat. No. 5,413,518 "Proximity Responsive Toy" describes a toy incorporating a capacitive sensor coupled to a high frequency oscillator, whereby the frequency of the oscillator is determined in part by the proximity of any conductive object (such as a human hand) to the capacitive sensor. This system has the disadvantage of using a plate capacitor, which is thick, inflexible and costly.

U.S. Pat. No. 6,955,603 "Interactive Gaming Device Capable of Perceiving User Movement" describes another approach to sensing player interaction by using a series of light emitters and light detectors to measure the intensity of light reflected from a player's hand or other body part. Such a system requires numerous expensive light emitters and light detectors, in particular for increasing the spatial sensitivity for detection.

U.S. Pat. No. 5,645,432 "Toy or Educational Device" describes a toy or educational device that includes front and back covers, a spine, a plurality of pages, a plurality of pressure sensors mounted in the front and back covers and a sound generator connected to the pressure sensors. The pressure sensors are responsive to the application of pressure to an aligned location of a page overlying the corresponding cover for actuating the sound generator to generate sounds associated with both the location of the sensor which is depressed and the page to which pressure is applied.

U.S. Pat. No. 5,538,430 "Self-reading Child's Book" describes a self-reading electronic child's book that displays a sequence of indicia, such as words, and has under each indicia a visual indicator such as a light-emitting diode with the visual indicators being automatically illuminated in sequence as the child touches a switch associated with each light-emitting diode to sequentially drive a voice synthesizer that audibilizes the indicia or word associated with the light and switch that was activated.

U.S. Pat. No. 4,299,041 "Animated Device" describes a device in the form of a greeting card, display card, or the like, for producing a visual and/or a sound effect that includes a panel member or the like onto which is applied pictorial and/or printed matter in association with an effects generator, an electronic circuit mounted on the panel member but not visible to the reader of the matter but to which the effects generator is connected, and an activator on the panel member, which, when actuated, causes triggering of the electronic circuit to energize the effects generator.

Each of the prior art patents included above describes a game, toy, book, and/or card that requires expensive components or manufacturing techniques and/or exhibits limited functionality. As will be described below, embodiments of the present invention overcome these limitations.

SUMMARY AND ADVANTAGES

Embodiments of an electronic instrument simulating a percussion instrument using capacitive touch sensitive sensors are described herein. Embodiments of a simulated percussion instrument comprise an art layer, a sensor layer, a shielding layer, an electronics package and a speaker. The art layer has depictions of one or more percussion instruments. The sensor layer is deposed under the art layer. The sensor layer has one or more instrument sensors, each comprising one or more capacitive touch sensors. Each instrument sensor is positioned underneath one of the depicted percussion instruments in the art layer so that a finger tapping the depicted instrument will trigger the sensor. Each of the capacitive touch sensors is electrically connected to the electronics package. The electronics package is configured to detect changes in capacitance sufficient to be a "triggering event" that occur when a particular capacitive touch sensor is touched.

In some embodiments, when a triggering event is detected in a capacitive touch sensor, when in certain modes, the electronics package plays on the speaker a sound sample of a percussion instrument associated with that capacitive touch sensor. When in other modes, the electronics package plays on the speaker a percussion instrumental track of a song along with other background and vocal tracks, muting at a phrase maker in the percussion instrumental track when no instrument sensor has been triggered for a period of time and unmuting after a triggering event on one of the instrument sensors.

The shielding layer serves to shield the backside of the sensor layer, reducing the risk that a sensor in the sensor layer will be triggered from the backside. An electronics package electrically connected with the sensor layer has an audio engine to pay sound samples of percussion instruments.

In some embodiments, the shielding layer comprises a conductive ground plane layer adjacent a separation layer. In other embodiments, the shielding layer comprises an air gap structure to create an air gap layer adjacent the sensor layer.

In some embodiments, the instrument sensors are star-shaped, providing a change in capacitance that varies depending on how far from the center of the instrument sensor a triggering event (such as a finger touch or near finger touch) occurs.

The embodiments of the present invention present numerous advantages, including: (1) inexpensive and simple construction; (2) substantially one-sided triggering of the capacitive touch sensors; (3) thin construction; and (4) integration of artwork on a layer or substrate with the capacitive touch sensors.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

REFERENCE NUMBERS USED IN DRAWINGS

Figure 1:
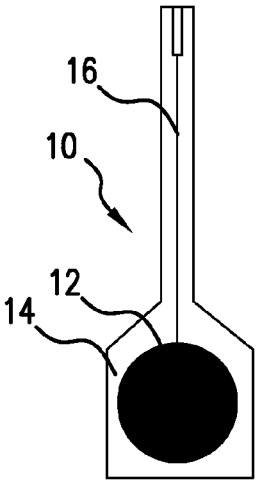
FIGS. 1-4 illustrate several embodiments of thin film capacitive touch sensors with different fill patterns.

In the drawings, similar reference characters denote similar elements throughout the several figures. With regard to the reference numerals used, the following numbering is used throughout the various drawing figures:

| | |
|---|---|
| 10 | thin film capacitive touch sensor |
| 12 | capacitive element |
| 14 | thin film substrate |
| 16 | interconnect |
| 20 | 50% fill pattern capacitive touch sensor |
| 22 | 50% fill pattern capacitive element |
| 30 | 35% fill pattern capacitive touch sensor |
| 32 | 35% fill pattern capacitive element |
| 34 | thin film capacitive touch sensor |
| 36 | capacitive field |
| 42 | art layer |
| 44 | sensor layer |
| 46 | capacitive elements |
| 48 | thin film substrate |
| 52 | art layer |
| 54 | sensor layer |
| 56 | capacitive elements |
| 58 | thin film substrate |
| 60 | one-sided thin film capacitive touch sensor |
| 62 | conductive ground plane layer |
| 64 | sensor layer |
| 66 | separation layer |
| 70 | one-sided thin film capacitive touch sensor |
| 71 | capacitive elements |
| 72 | conductive ground plane layer |
| 74 | sensor layer |
| 76 | separation layer |
| 78 | thin film |
| 80 | electronics |
| 170 | one-sided thin film capacitive touch sensor |
| 172 | sensor layer |
| 174 | air gap structure |
| 176 | air gap layer |
| 180 | one-sided thin film capacitive touch sensor |
| 182 | sensor layer |
| 184 | air gap structure |
| 186 | air gap layer |
| 190 | one-sided thin film capacitive touch sensor |
| 192 | sensor layer |
| 194 | dielectric block |
| 200 | one-sided thin film capacitive touch sensor |
| 202 | sensor layer |
| 204 | corrugated structure |
| 206 | air gap layer |
| 208 | capacitive field |
| 240 | simulated percussion instrument |
| 242 | art layer |
| 244 | sensor layer |
| 246 | drum platform |
| 248 | conductive ground plane layer |
| 250 | electronics package |
| 252 | speaker |
| 290 | simulated percussion instrument |
| 292 | art layer |
| 294 | sensor layer |
| 296 | drum platform |
| 298 | air gap structure |
| 300 | electronics package |
| 302 | speaker |
| 372 | art layer |
| 374 | sensor layer |
| 376 | instrument sensor |
| 386 | control sensor |
| 388 | pcb bus connection |
| 390 | conductive trace |
| 400 | single drum sensor |

-continued

| | |
|---|---|
| 402 | drum artwork |
| 404 | conductive trace |
| 412 | cymbal bell sensor |
| 414 | cymbal bow sensor |
| 416 | conductive trace |
| 422 | drum head sensor |
| 424 | rim shot sensor |
| 430 | star-shaped capacitive touch sensor |
| 432 | conductive trace |
| 440 | interdigited ring sensor |
| 442 | interdigited center sensor |
| 444 | interdigitation pattern sensor |

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

FIGS. 1-24 illustrate embodiments of capacitive touch sensors and simulated percussion instruments using capacitive touch sensors. The simulated percussion instruments described in these embodiments simulate drum sets, but those of skill in the art will realize that the teachings describe herein are applicable to other electronic musical instruments simulating percussion musical instruments such as xylophones, gamelans, glockenspiels, marimbas, etc.

Capacitive Touch Sensor Design

Figure 7:
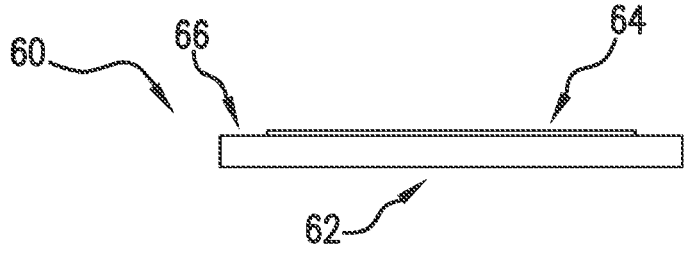
FIG. 7 illustrates a one-sided thin film capacitive touch sensor with a conductive ground plane layer for shielding.
Figure 8:
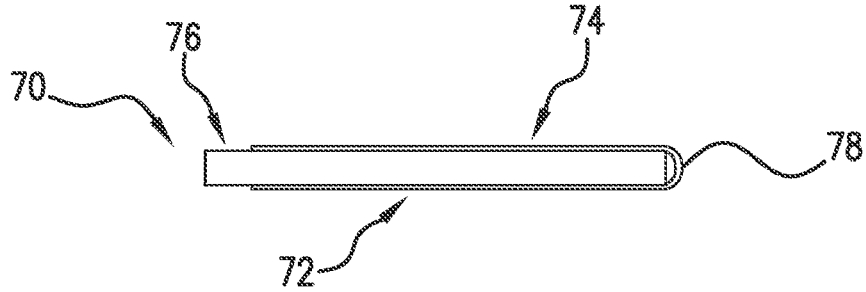
FIG. 8 illustrates a one-sided thin film capacitive touch sensor with an alternative ground plane configuration.
Figure 9:
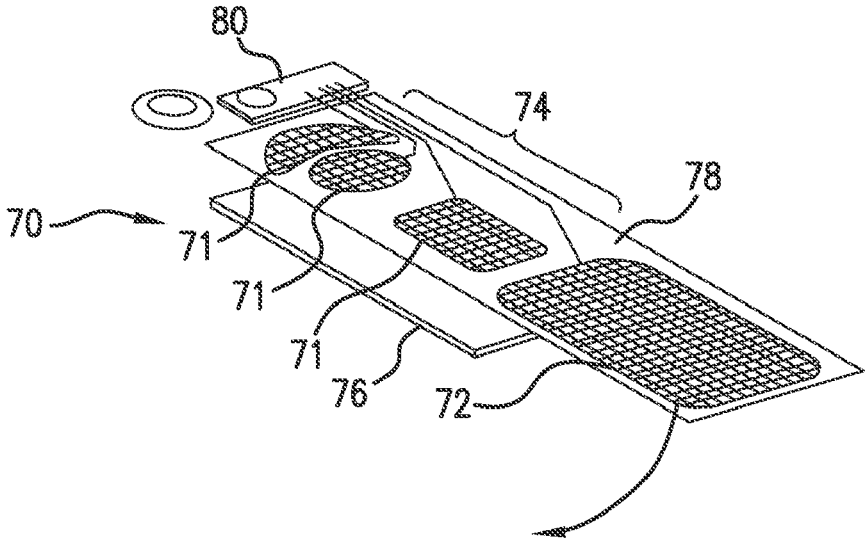
FIG. 9 shows another view of the one-sided thin film capacitive touch sensor of FIG. 8.

FIGS. 1-6 generally describe the construction of two-sided thin film capacitive touch sensors. FIGS. 7-9 generally describe one-sided thin film capacitive touch sensors with shielding on one side provided by conductive ground plane layers. FIGS. 10-13 generally describe one-sided thin film capacitive touch sensors with shielding on one side provided by air gap structures or dielectric block.

Many existing capacitive touch sensor design kits available from manufacturers use printed circuit boards to create and connect thin film capacitive touch sensors. This approach is too expensive and cumbersome for most low-cost applications (e.g., game, toy, book, etc.). A low-cost alternative is to manufacture thin film capacitive touch sensors (thin compared to printed circuit boards). One method of manufacturing thin film capacitive touch sensors is to print the elements of the capacitors with conductive ink onto a thin film substrate using a screen printing technique. The thin film substrate may be a sheet of material like plastic (e.g., polyester) or paper. In addition to being lower cost than a printed circuit board, thin film substrates such as polyester or paper are more flexible.

FIGS. 1-4 illustrate several embodiments of thin film capacitive touch sensors with different fill patterns. FIG. 1 shows a thin film capacitive touch sensor 10 with a solid fill pattern. The thin film capacitive touch sensor 10 has a thin film substrate 14 and a capacitive element 12. The capacitive element 12 is made of conductive ink deposited without porosity on the thin film substrate 14, giving it a solid fill pattern. In this embodiment, the conductive ink is deposited using a screen printing technique, but in other embodiments, other techniques may be used. The thin film capacitive touch sensor 10 also has an interconnect 16, configured to electrically connect the capacitive element 12 to circuits outside of the thin film capacitive touch sensor 10. In this embodiment, the interconnect 16 is also conductive ink deposed on the thin film substrate 14. Capacitive elements and interconnects are collectively referred to herein as "conductive pathways."

The conductive ink used generally includes a polymer and a metal and/or carbon conductive material. For example, the polymer may include powdered and/or flaked silver, gold, copper, nickel, and/or aluminum. In some embodiments, the conductive pathways range from less than 100 Ohms to 8K Ohms resistance, depending on their material composition and configuration. Conductive ink with less conductive material may be less expensive, but may exhibit greater resistivity. Conductive ink with a greater amount of conductive material may be more expensive, but may exhibit decreased resistivity.

Alternately, instead of screen printed conductive ink, one or more of the conductive pathways may be formed from thin copper or other metal layers. For example, one or more of the conductive pathways may be formed from a thin copper sheet that is photo-lithographically patterned and etched to form one or more of the conductive pathways, i.e. the capacitive element and/or related interconnects. Capacitive elements with partial fill patterns may be etched from thin metal as well. The copper conductive pathways may be laminated to a flexible substrate layer. Accordingly, either the copper and conductive ink conductive pathway embodiments, or a combination thereof, may form at least part of a flexible circuit (e.g., a "flex" circuit).

The cost of capacitive touch sensors may be mitigated by substituting the capacitive element 12 with the solid fill pattern shown in FIG. 1 with a capacitive element having a partial fill pattern, resulting in a partial fill pattern capacitive touch sensor. The partial fill pattern capacitive element is porous. Stated differently, an area of the thin film substrate under the partial fill pattern capacitive element has less than complete conductive ink coverage. However, the partial fill pattern capacitive element is continuous, so that electrical charges can flow to all parts of the element.

Figure 2:
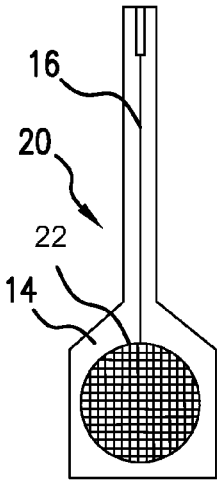
Figure 3:
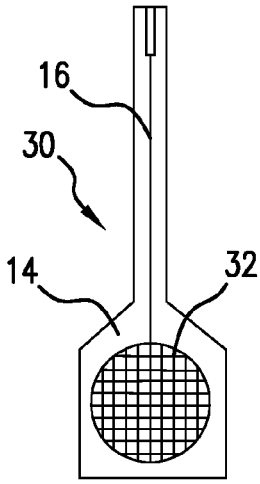

As examples of partial fill pattern capacitive touch sensors, FIG. 2 shows a 50% fill pattern capacitive touch sensor 20 and FIG. 3 shows a 35% fill pattern capacitive touch sensor 30. In FIG. 2, the 50% fill pattern capacitive touch sensor 20 has a 50% fill pattern capacitive element 22, meaning only 50% of a thin film substrate 14 under the 50% fill pattern capacitive element 22 is covered by conductive material. In FIG. 3, the 35% fill pattern capacitive touch sensor 30 has a 35% fill pattern capacitive element 32, meaning only 35% of a thin film substrate 14 under the 35% fill pattern capacitive element 32 is covered by conductive material. As the percentage of fill pattern decreases, the capacitance of the capacitive touch sensor is reduced, but the area covered by the capacitive touch sensor remains the same. For many applications that detect human finger touches, reducing the fill pattern down to as little as 35% may decrease the cost of the capacitive touch sensor substantially without suffering significant performance loss. Thus a capacitive element can remain a large target for a user to touch, but with reduced conductive material.

In the embodiments shown in FIGS. 1-3, the partial fill pattern shown is a rectilinear grid of crisscrossed horizontal and vertical lines intersecting at right angles. However, other partial fill patterns may be used, such as a regular pattern of small circular pores. For convenience, herein "grid" shall mean any partial fill pattern.

Figure 4:
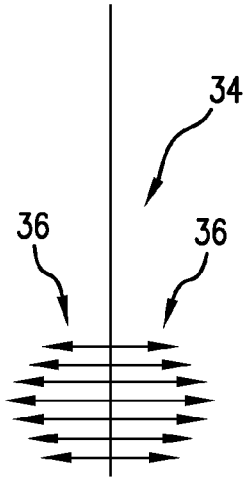

FIG. 4 shows a side view of a thin film capacitive touch sensor 34 like those discussed regarding FIGS. 1-3. When charged, a capacitive field 36 extends from the front and back of the thin film capacitive touch sensor 34. The capacitive field 36 is an electrical field that will interact with nearby conductive objects, such as a human finger, changing the effective capacitance of the thin film capacitive touch sensor 34. The thin film capacitive touch sensor 34 can be said to be "two-sided," since interaction with the capacitive field 36 on either the front side or back side can be detected via the change in effective capacitance.

In some embodiments, any additional electronics that couple to the one or more capacitive elements and related interconnects may be at least in part be included on the same flexible substrate as the one or more thin film capacitive touch sensors. Alternately, at least some of the additional electronics may be included on a separate substrate. For example, at least some of the electronics may be included on a separate printed circuit board. Multiple circuits on multiple substrates may be electrically coupled together with any electrical coupling devices and/or methods known in the art.

Figure 5:
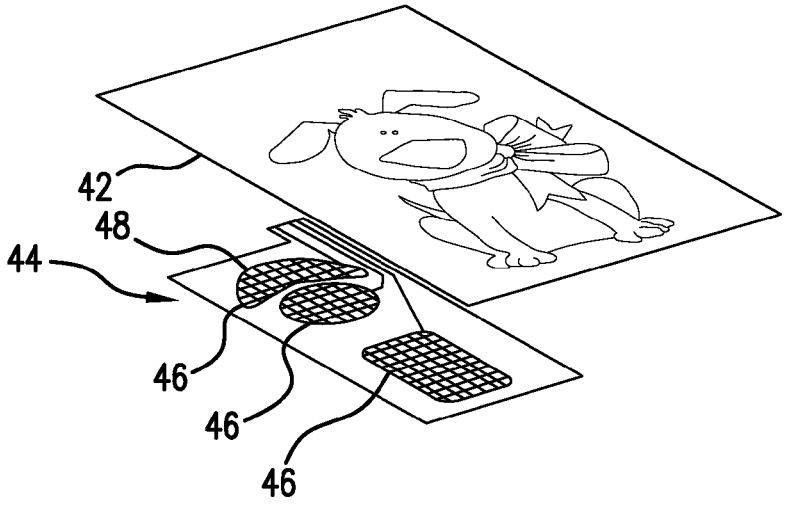
FIGS. 5 and 6 illustrate methods of combining thin film capacitive touch sensors with artwork.
Figure 6:
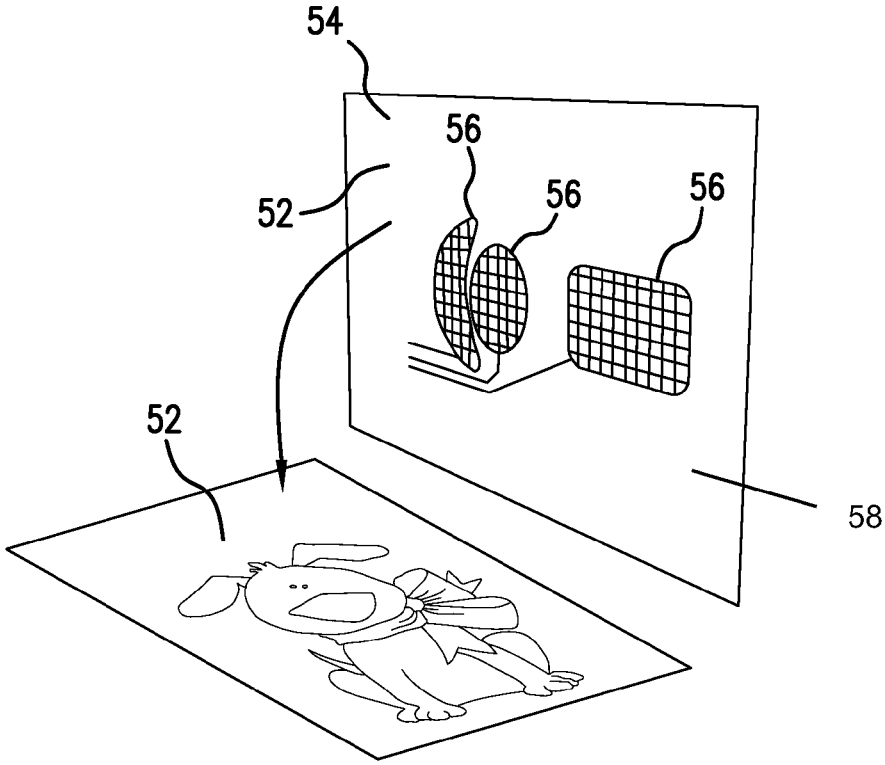

FIGS. 5 and 6 illustrate methods of combining thin film capacitive touch sensors with artwork. FIG. 5 illustrates a first method of combining thin film capacitive touch sensors with artwork. A sensor layer 44 is coupled to an art layer 42 by lamination, gluing or other process. This sensor layer 44 comprises one or more capacitive elements 46 (three in the embodiment shown) deposed on a thin film substrate 48 (e.g. paper or plastic), forming one or more thin film capacitive touch sensors, similar in construction to those described in the discussion regarding FIGS. 1-4. In this embodiment, the capacitive elements 46 are conductive ink deposed on the thin film substrate 48 using a screen printing process. In other embodiments, the capacitive elements 46 may be made with lithography out of metal foil, or some other method.

FIG. 6 illustrates a second method of combining thin film capacitive touch sensors with artwork. Here, an art layer 52 comprises art printed directly onto a thin film substrate 58. One or more capacitive elements 56 are deposed onto the same thin film substrate 58 as well, forming a sensor layer 54. Thus in this embodiment, the capacitive touch elements are part of the art layer 52. Stated differently, the sensor layer 54 is integrated with the art layer 52. In some embodiments, an opaque layer of non-conductive ink may be printed on the art layer 52 over the art and the capacitive elements 56 printed over the opaque layer. This opaque layer substantially prevents the conductive pathways and/or product supporting structure from showing through the thin film substrate 58. In other embodiments, the capacitive elements 56 are printed directly over the art layer 52 without an opaque layer.

One-Sided Capacitive Touch Sensors with a Ground Plane

FIGS. 7-9 illustrate embodiments of one-sided thin film capacitive touch sensors with conductive ground plane layers as shielding layers to substantially mitigate the two-sided functionality of the thin film capacitive touch sensors described in the discussion above regarding FIGS. 1-6. For devices that may be handheld, such as games, toys, books, and greeting cards, one-sided thin film capacitive touch sensors may improve the ability with which a user may properly interact with such devices.

FIG. 7 illustrates a one-sided thin film capacitive touch sensor 60 with a conductive ground plane layer 62. The one-sided thin film capacitive touch sensor 60 comprises a sensor layer 64 separated from the conductive ground plane layer 62 with a separation layer 66. The sensor layer 64 is a two-sided thin film capacitive touch sensor as described in the discussion regarding FIGS. 1-4. In this embodiment, the separation layer 66 is a thin sheet of dielectric material like paper or plastic. The conductive ground plane layer 62 is constructed by mounting a very thin sheet of conductive material such as aluminum foil or screen printed conductive ink on the backside of the separation layer 66. The separation between the sensor layer 64 and the conductive ground plane layer 62 is a minimum of 0.5 mm. Any separation less than 0.5 mm causes base capacitance of the sensor layer 64 to increase dramatically, so much so that any touch by a human finger will not change the effective capacitance of the sensor layer 64, rendering such touches undetectable. Any separation less than 0.5 mm may also cause the one-sided thin film capacitive touch sensor 60 to experience large changes in base capacitance when the sensor layer 64 experiences mechanical bending. Simply flexing the one-sided thin film capacitive touch sensor 60 may lead to fluctuations in effective capacitance larger than those typically seen when one-sided thin film capacitive touch sensor 60 is touched by a human finger, degrading the touch sensitivity of the one-sided thin film capacitive touch sensor 60.

FIG. 8 illustrates a one-sided thin film capacitive touch sensor 70 with an alternative ground plane configuration. The one-sided thin film capacitive touch sensor 70 has one or more capacitive elements 71 (not visible this view, see FIG. 9) deposed on a thin film 78 to form a sensor layer 74 and a conductive ground plane layer 72 both deposed on thin film 78, the thin film 78 wrapped around a separation layer 76. In this embodiment, the separation layer 76 is a thin sheet of dielectric material like paper or plastic.

FIG. 9 shows another view of the one-sided thin film capacitive touch sensor 70 of FIG. 8, showing the capacitive elements 71 and conductive ground plane layer 72 deposed on the same thin film 78, the thin film 78 laid flat, but configured to be wrapped around separation layer 76 (see FIG. 9 with arrow showing wrapping action). The conductive ground plane layer 72 may be a grid or solid fill pattern, as described above regarding FIGS. 1-4. In some embodiments, capacitive elements 71 and the conductive ground plane layer 72 may be formed from the same conductive material (e.g., conductive ink) and substantially simultaneously (e.g., from the same patterned printing screen). Also shown are electronics 80 for measuring the effective capacitance of the one-sided thin film capacitive touch sensor 70.

One-Sided Capacitive Touch Sensors with Air Gap Structures

FIGS. 10-13 illustrate embodiments with air gap structures as shielding layers to substantially mitigate the two-sided functionality of the thin film capacitive touch sensors described above in the discussion of FIGS. 1-6. For devices that may be handheld, such as games, toys, books, and greeting cards, the one-sided functionality of the thin film capacitive touch sensors may improve the ability with which a user may properly interact with such devices.

As an alternate approach to using a conductive ground plane layer shield to form a substantially one-sided capacitive touch sensor, other embodiments use materials with very low dielectric constants as a shield for one side of the capacitive touch sensor. More specifically, one very inexpensive material with a very low dielectric constant is air. The inclusion of an air gap layer will lower the capacitive sensitivity on the air gap layer side of the capacitive touch sensor. Nevertheless, a capacitive field may still be triggered by proximity though the air depending on the configuration of the capacitive touch sensor. Accordingly, one-sided thin film capacitive touch sensors with an air gap layer should be tested for any potential application to determine their suitability. For example, there is a relationship between the size/area of a touch capacitive touch sensor and its proximity sensitivity through air. Generally, larger capacitive touch sensors are more sensitive and may require a thicker air-gap for proper shielding. As a guideline, the air gap layer should be at least the thickness of any overlay material on top of the capacitive elements. For example, a configuration that includes a thin film capacitive touch sensor that is 2 mil thick (thin film with capacitive elements printed in conductive ink on its underside), an art layer that is 10 mil thick and a 5 mil layer of glue totals an overlay of 17 mil over the capacitive elements. This would suggest an air gap layer of at least a 17 mil (~0.5 mm). For capacitive elements less than 2 square inches in area, an air gap layer of five times the overlay thickness have proven to be sufficient.

Figure 10:
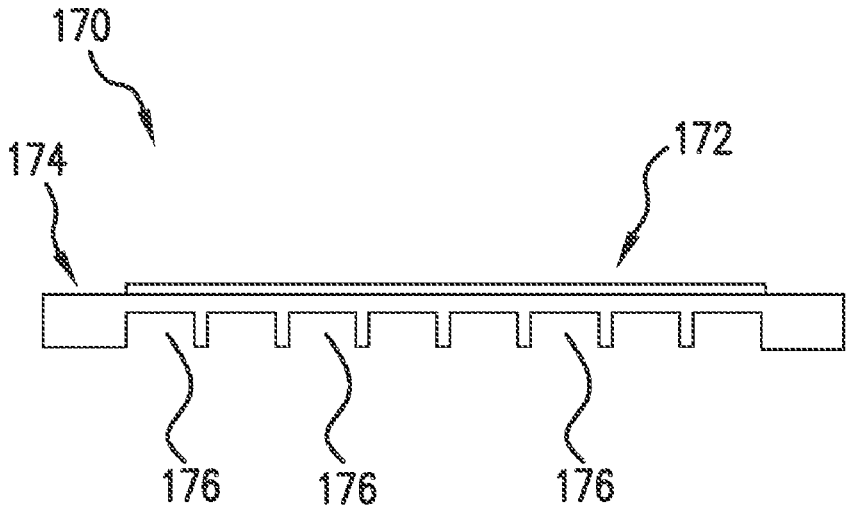
FIG. 10 illustrates a side view of a capacitive touch sensor with an air gap structure for shielding.

FIG. 10 shows a side view of an embodiment of a one-sided thin film capacitive touch sensor 170 with an air gap layer 176 for a shielding layer. The one-sided thin film capacitive touch sensor 170 includes a sensor layer 172 mounted to an air gap structure 174. The air gap structure 174 has a molded or cut pattern to create the air gap layer 176 on a side of the air gap structure 174 opposite the sensor layer 172. The air gap structure 174 prevents foreign objects, such as a human finger, from entering the air gap layer 176 and changing the effective capacitance of a sensor in the sensor layer 172. The air gap layer 176 mitigates sensitivity to touch from the bottom, as explained above. In this embodiment the air gap structure 174 has a lattice structure, but in other embodiments, structures with other geometries, such as a corrugation structure, may be used to create the air gap layer 176.

Figure 11:
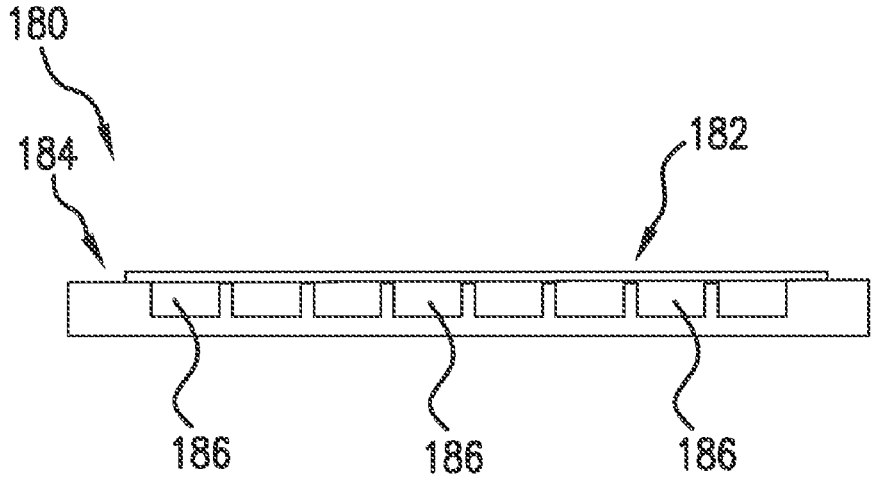
FIG. 11 illustrates a side view of a capacitive touch sensor of an alternate embodiment with an air gap structure for shielding.

FIG. 11 shows a side view of one-sided thin film capacitive touch sensor 180 including an air gap layer 186 for a shielding layer. The one-sided thin film capacitive touch sensor 180 includes a sensor layer 182 mounted to an air gap structure 184. The air gap structure 184 has a molded or cut pattern to create the air gap layer 186 on a side of the air gap structure 184 closest to the sensor layer 182. The air gap structure 184 prevents foreign objects, such as a human finger, from entering the air gap layer 186 and changing the effective capacitance of a sensor in the sensor layer 182. The air gap layer 186 mitigates sensitivity to touch from the bottom. In this embodiment the air gap structure 184 has a lattice structure, but in other embodiments, structures with other geometries, such as a corrugation structure, may be used to create the air gap layer 186.

Figure 12:
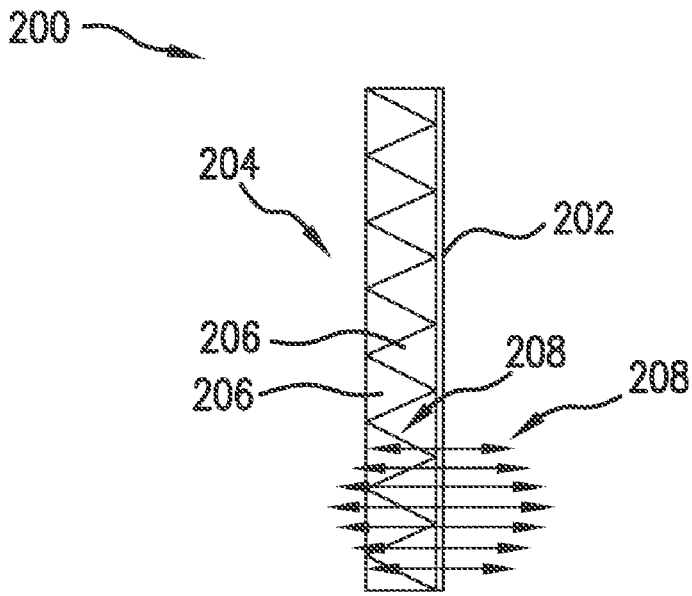
FIG. 12 illustrates a side view of a capacitive touch sensor mounted on corrugated cardboard for shielding.

FIG. 12 shows a one-sided thin film capacitive touch sensor 200 with air gap layer 206 provided by a corrugated structure 204, such as corrugated cardboard or similar materials. The thin film capacitive touch sensor 200 has a sensor layer 202 mounted on the corrugated structure 204, which mitigates sensitivity to touches on a side of the sensor layer 202 nearest the corrugated structure 204 (i.e. the back side) due to diminished strength of a capacitive field 208 generated by the sensor layer 202 after passing through the corrugated structure 204. Such corrugated structures, in particular with corrugated cardboard and the like, are inexpensive construction materials common to games and toys.

One-Sided Capacitive Touch Sensors with Dielectric Blocks

Figure 13:
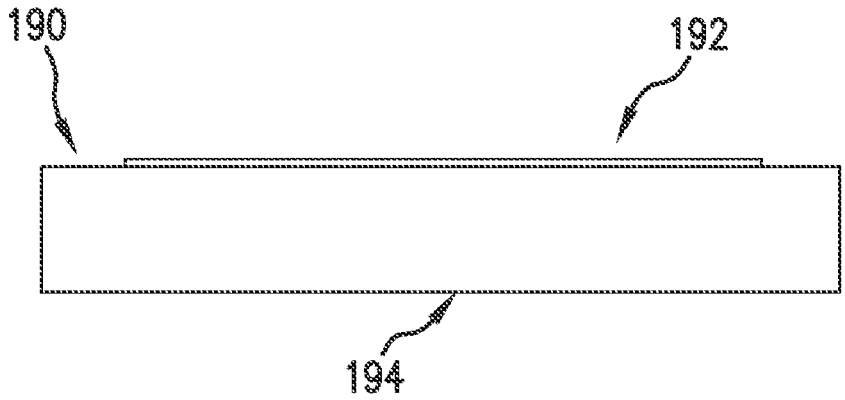
FIG. 13 illustrates a side view of a capacitive touch sensor of an alternate embodiment with dielectric block for shielding.

FIG. 13 shows a side view of a one-sided thin film capacitive touch sensor 190 with a dielectric block 194 for a shielding layer. The one-sided thin film capacitive touch sensor 190 includes a sensor layer 192 mounted to the dielectric block 194. The dielectric block 194 is a non-conducting material such as plastic or cardboard. The one-sided thin film capacitive touch sensor 190 reduces or eliminates sensitivity to touches on the back side of the sensor layer 192 with the dielectric block 194. The dielectric block 194 forces such touches further from the back side of the sensor layer 192 and accordingly reduces change to effective capacitance of the sensor layer 192 during such touches. Generally, larger capacitive touch sensors are more sensitive and may require a thicker dielectric material for proper shielding. As a guideline, the dielectric block should be at least the thickness of any overlay material on top of the capacitive elements. For example, a configuration that includes a thin film capacitive touch sensor 2 mil thick (thin film with capacitive elements deposed in conductive ink on its underside), an art layer 10 mil thick and a 5 mil layer of glue totals an overlay of 17 mil over the capacitive elements. This would suggest a dielectric block layer of at least a 17 mil (~0.5 mm). For capacitive elements less than 2 square inches in area, a dielectric block layer of five times the overlay thickness have proven to be sufficient.

Further, the sensor layers described in the embodiments above need not be planar layers. For example, sensor layers (and any ground plane shield layer and/or air gap layer) may be formed in a non-planar configuration. Further, for a substantially enclosed non-planar configuration (e.g., a bottle, can, or other container), the interior of the container may serve as the air gap layer to substantially mitigate or prevent false and/or unintentional capacitive touch sensor triggering.

Simulated Percussion Instruments with Capacitive Touch Sensors

Figure 14:
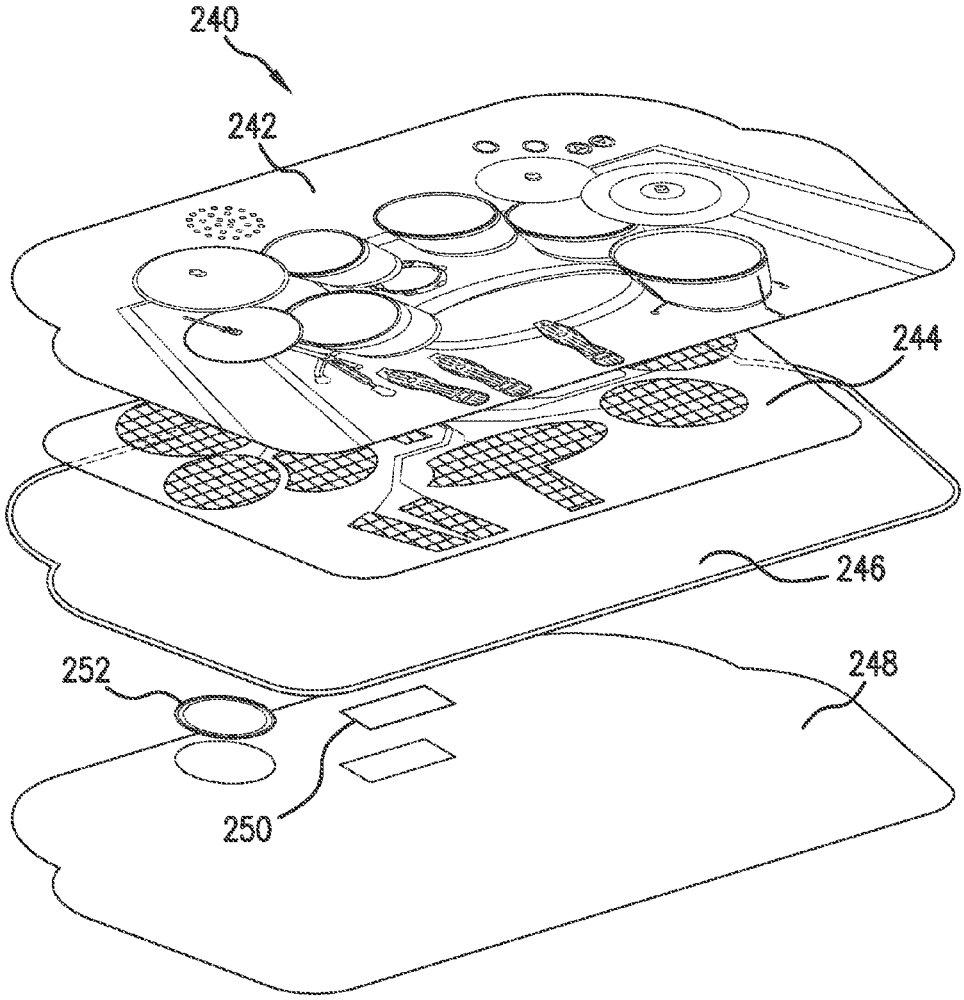
FIG. 14 illustrates simulated percussion instrument construction with an art layer, a thin film sensor layer, and one or more conductive ground plane layers.
Figure 15:
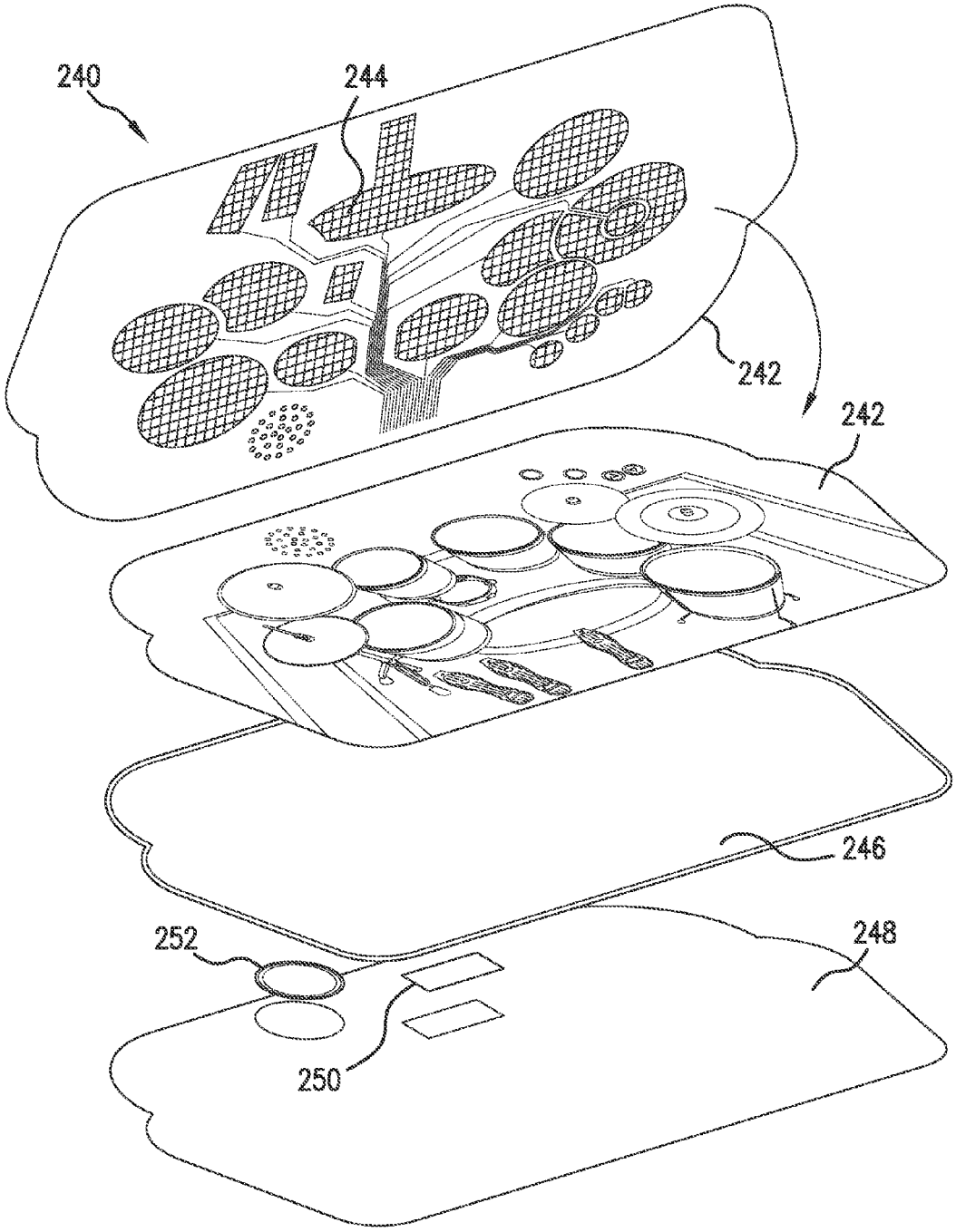
FIG. 15 illustrates simulated percussion instrument construction with a thin film sensor layer combined with an art layer to form an integrated layer, and one or more conductive ground plane layers.

FIG. 14 illustrates an embodiment of a simulated percussion instrument 240 with capacitive touch sensors and a conductive ground plane layer. The simulated percussion instrument 240 has an art layer 242, a sensor layer 244, a drum platform 246, a conductive ground plane layer 248, an electronics package 250, and a speaker 252. In this embodiment, the simulated percussion instrument 240 simulates a drum set, so the art layer 242 has artwork depicting a drum set with several different types of drums and cymbals. The sensor layer 244 has one or more capacitive touch sensor elements constructed as described above in the discussion of FIGS. 1-4. The sensor layer 244 and art layer 242 combined as described above in the discussion of FIG. 5, as two separate layers, with separate substrates, that are coupled together by lamination, gluing or other coupling process. Capacitive elements in the sensor layer 244 are shaped and positioned so as to align with associated images of drums and cymbals in the art layer 242 when the two layers are coupled together. The electronics package 250 is electrically connected with the speaker 252 and the sensor layer 244 by electrically conductive pathways (not shown). The electronics package 250 is configured to check the capacitive elements in the sensor layer 244 for changes in capacitance, which would indicate someone has touched the depiction of a drum or cymbal above a particular capacitive element. The electronics package 250 is further configured to select a sound recording (sound sample) from its memory based on detection of a touch to a particular capacitive element or combination of elements and play the sound recording on the speaker 252. The drum platform 246 serves as a separation layer between the sensor layer 244 and the conductive ground plane layer 248, making the capacitive elements in the sensor layer 244 function as one-sided capacitive touch sensors, to reduce the risk of false and/or unintentional capacitive sensor triggering on the underside of the simulated percussion instrument 240, as described in the discussion above regarding FIGS. 7-9. The drum platform 246 also provides mechanical strength to the sensor layer 244 and art layer 242, protecting these thin layers from deformation when touched. An alternative embodiment, as illustrated by FIG. 15, the sensor layer 244 may be combined with the art layer 242 in an integrated layer with a single substrate, having full color deposed on the front side and the capacitive elements deposed on the backside or underside, as described in the discussion above regarding FIG. 6. Otherwise, the embodiment of FIG. 15 is substantially similar to the embodiment of FIG. 14.

Figure 16:
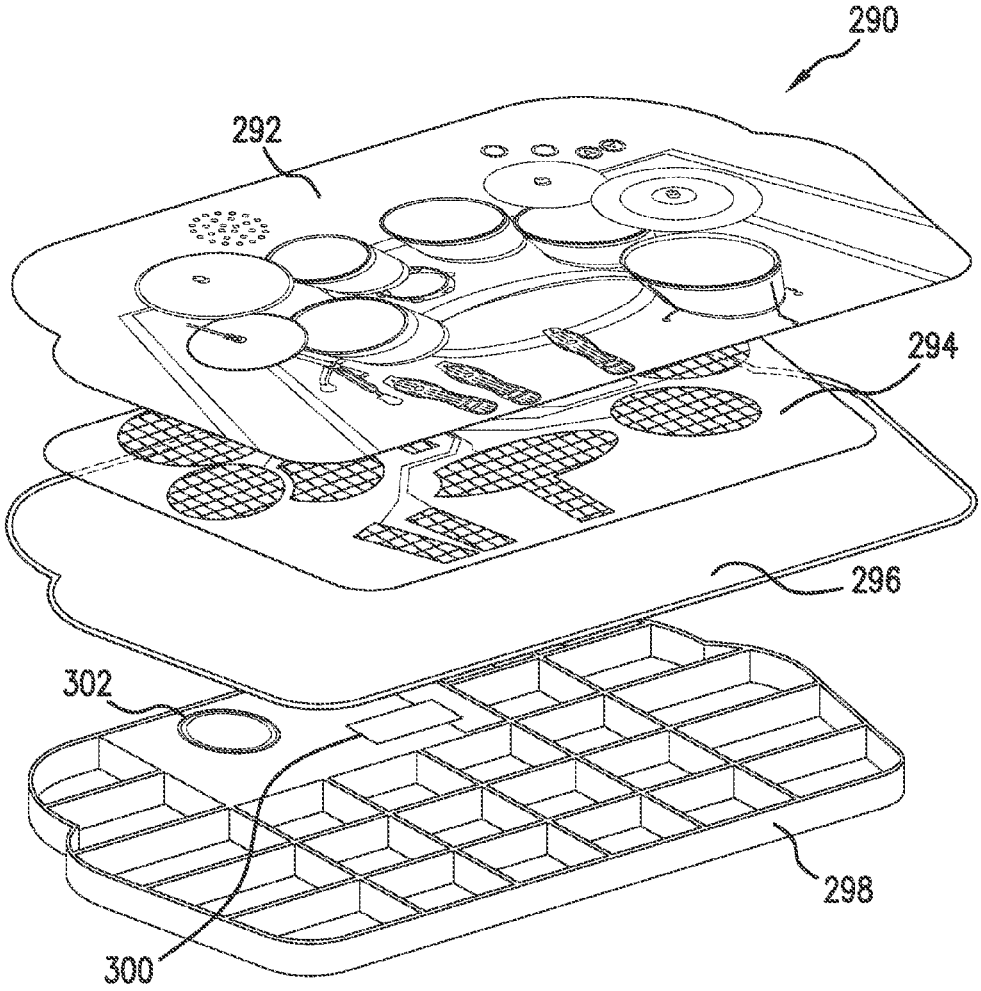
FIG. 16 illustrates simulated percussion instrument construction with an art layer, a thin film sensor layer, and an air gap structure.

FIG. 16 illustrates an embodiment of a simulated percussion instrument 290 with capacitive touch sensors and an air gap structure 298. The simulated percussion instrument 290 also has an art layer 292, a sensor layer 294, a drum platform 296, an electronics package 300, and a speaker 302.

Figure 17:
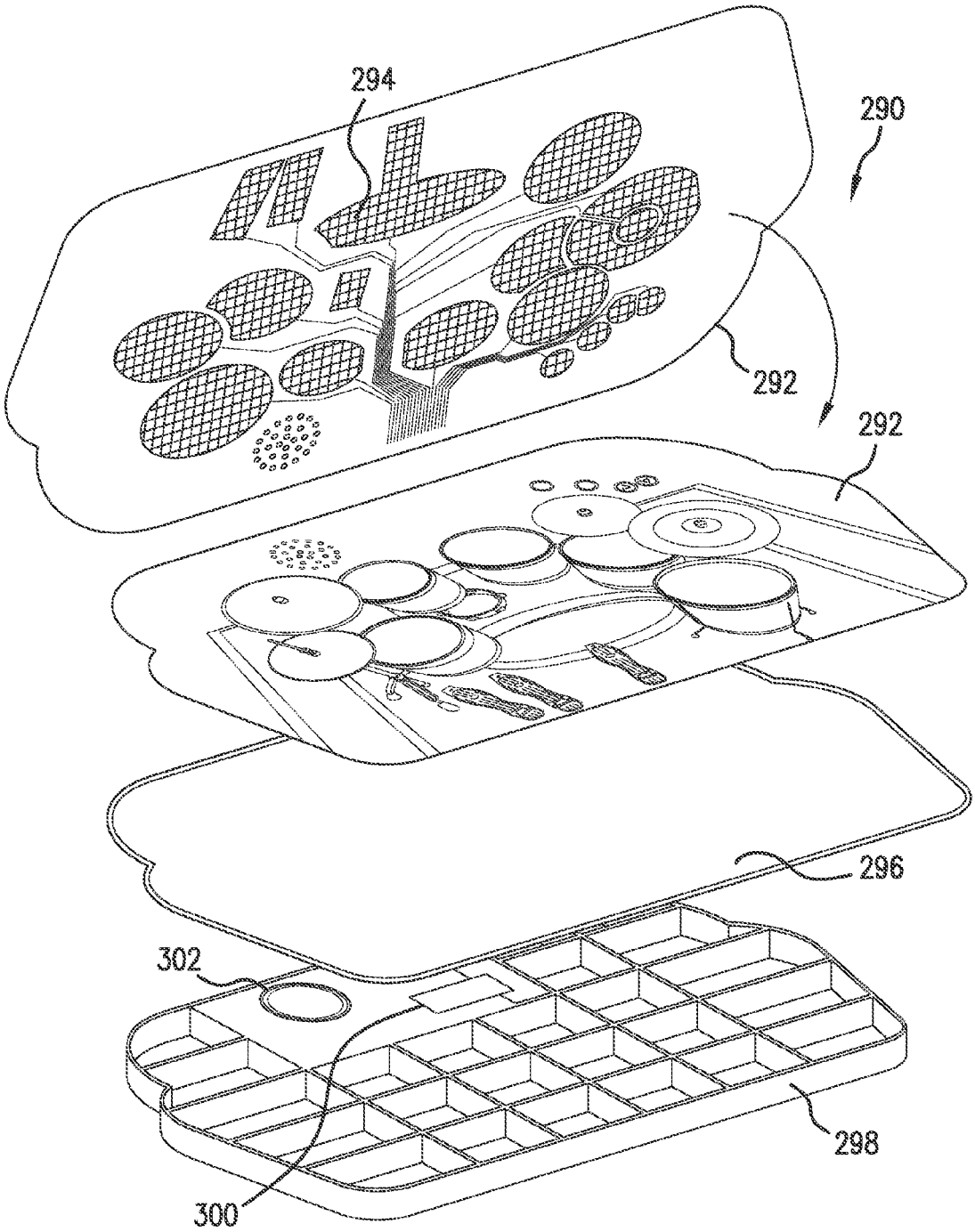
FIG. 17 illustrates simulated percussion instrument construction with a thin film sensor layer combined with an art layer to form an integrated layer, and an air gap structure.

The air gap structure 298 may be constructed/molded in plastic or other non-conductive material with a lattice, corrugated or other structure formed therein to create an air-gap layer behind the sensor layer 294. This air gap layer will reduce the risk of false and/or unintentional capacitive sensor triggering on the underside of the simulated percussion instrument 290, as described above in the discussion regarding FIGS. 10-13. Otherwise, the construction and function of the embodiment of FIG. 16 is similar to the embodiment of FIG. 14. An alternative embodiment, as illustrated by FIG. 17, the sensor layer 294 may be combined with the art layer 292 in an integrated layer having a single substrate with full color printing on the front side and the capacitive elements on the backside or underside, as described in the discussion above regarding FIG. 6. Otherwise, the embodiment of FIG. 17 is substantially similar to the embodiment of FIG. 16.

Though not illustrated, construction of a simulated percussion instrument may include a combination of an air gap structure (producing an air gap layer) and a conductive ground plane layer. In particular, art details may be printed in full color on paper or plastic sheets, allowing the simulated percussion instrument to be overall very thin. Depending on overall configuration of the drum platform and air gap structure, the construction may include at least one ground plane layer to shield at least a portion of the capacitive elements and at least one air gap layer to shield at least another portion of the capacitive elements. The inclusion of the conductive ground plane behind at least some capacitive elements obviates the need for a plastic housing in that region, thereby enabling that region of the simulated drum set to be substantially thin. Alternately, the air gap structure forms an air gap or lattice of air gaps behind the capacitive elements in thicker regions of the simulated percussion instrument that include the air gap structure. Accordingly, the overall shape of the simulated percussion instrument may be flexible as the shape of the drum platform and the air gap structure need not substantially match. Said differently, capacitive elements adjacent only the drum platform (and shielded by a conductive ground plane only) may operate substantially similarly to capacitive sensors adjacent the drum platform and the air gap structure (and shielded by an air gap, conductive ground plane, or a combination thereof).

Sensor Layout and Function

The layout of individual capacitive touch sensors and functions associated with each determines the interactivity a user may have with a simulated percussion instrument. FIGS. 18-23 illustrate an embodiment of a simulated percussion instrument simulating a drum set with a specific layout of capacitive touch sensors. The capacitive touch sensors may be constructed as described with reference to FIGS. 1-13. Functions described in the discussion below of FIGS. 18-24 are performed by the capacitive touch sensors together with an electronics package (microprocessors, memory, etc.) and speaker that are not described in detail, but whose structure and general function will be known to those skilled in the art (See FIGS. 14-17 for an example of the physical location of electronic package and speaker within the simulated percussion instrument of that embodiment).

Figure 18A:
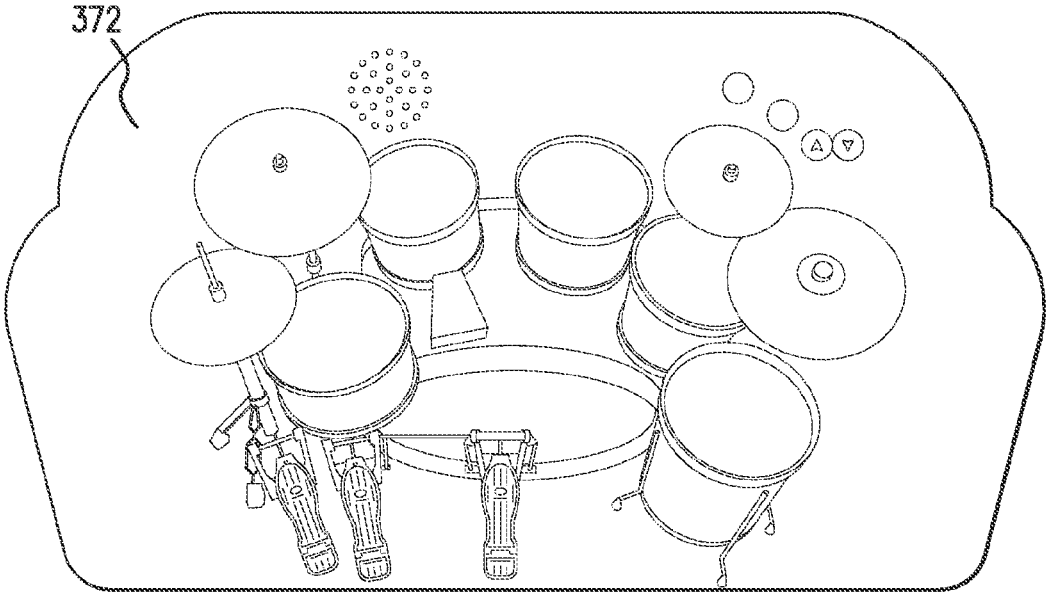
FIGS. 18A and 18B illustrate an embodiment of sensor and artwork layout in a simulated drum set.
Figure 18B:
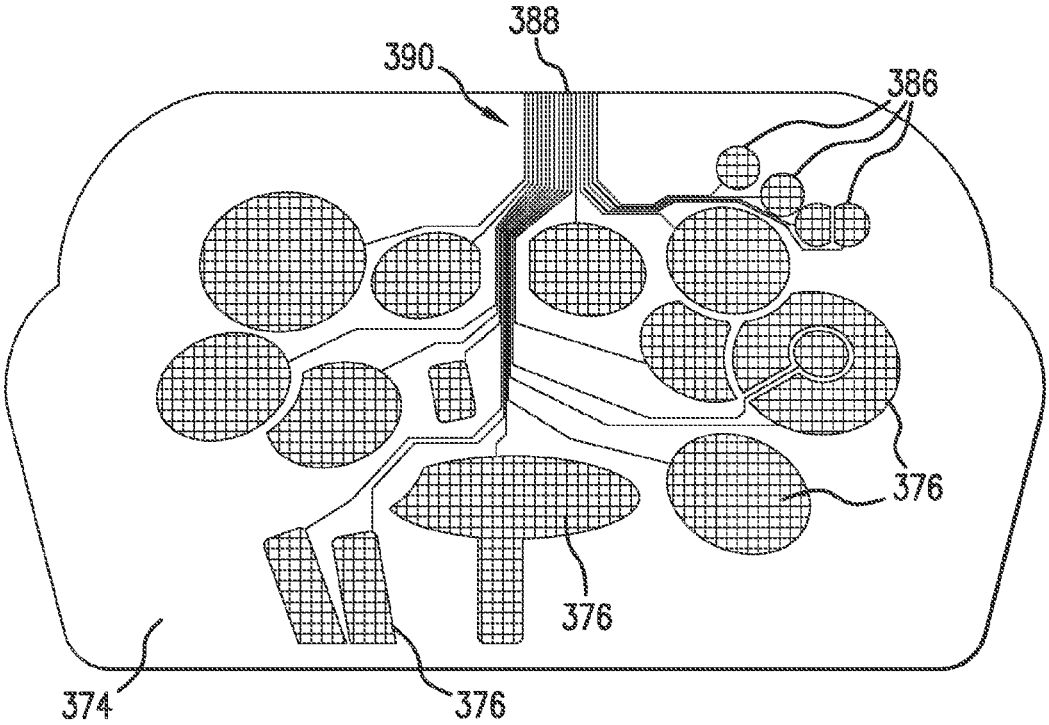

FIGS. 18A and 18B illustrate an embodiment of sensor and artwork layout in a simulated drum set. FIG. 18A shows the art layer 372 in detail, with artwork of toms, snare, bass, cymbals and pedals. FIG. 18B shows the sensor layer 374 with instrument sensors 376 control sensors 386 and conductive traces 390. Together, FIGS. 18A and 18B illustrate the combination of the art layer 372 and the instrument sensors 376 in the underlying sensor layer 374 produces touch sensitive/responsive portions or areas of the simulated drum set, or "touch spots" to emulate one or more functional areas of a real drum set. The instrument sensors 376 may be scaled to be played with two hands and multiple fingers. Typically the lower areas of the simulated drum set (pedals and bass) are played with the thumbs and the upper areas (cymbals, toms, and snare) are played with the fingers.

FIGS. 18A and 18B further illustrate one or more control sensors 386 included in the simulated drum set. For example, one or more control sensors 386 may correspond to and be located underneath one or more control knob artwork on the art layer 372 of the simulated drum set. In one embodiment, the one or more control sensors 386 may require substantially continuously touching for a period of time (in one embodiment approximately 0.5 seconds or more) before they are activated. This requirement for substantially continuous touching may prevent the control sensors 386 from accidentally triggering during play given their location relative to the instrument sensors 376. The one or more control sensors 386 will be described in more detail below.

Some embodiments of the simulated drum set include four control sensors 386 that appear as buttons adjacent the drum set artwork. In these embodiments, the four control touch sensors are: "MODE" to select the song, play pattern, and other features of the drum; "VOLUME UP" to increase the overall volume of the simulated drum set; "VOLUME DOWN" to lower the overall volume of the drum; and "DEMO" to play a demo of the selected song or to stop music playback in any mode.

In addition to the dedicated control sensors, the instrument sensors 376 may also be used to in combination with the MODE sensor to change modes. In order to select a different operating mode, the user may touch the MODE sensor to enable menu selection, and then touch one of the drums or cymbals to select a different operating mode. In some embodiments, the operating modes assigned to each instrument sensor are printed on the drum or cymbal artwork. More specifically, to select an operating mode, the user may hold the MODE sensor while simultaneously tapping or touching the drum or cymbal sensor associated with the operating mode. Alternately, the user may touch and release the MODE sensor before sequentially selecting a mode/function on the drums and cymbals. In this case, touching the MODE sensor a second time may cancel the mode selection process.

Volume control in some embodiments is implemented digitally, with the VOLUME UP and VOLUME DOWN buttons used to adjust the volume. Each time the VOLUME UP sensor is touched the overall volume of the simulated drum set may be increased until a maximum volume is reached. Alternatively, each time the VOLUME DOWN sensor is touched the overall volume of the simulated drum set may be lowered until the minimum volume is reached. The Volume controls may be used at any point, for example when a song is playing or not playing, to adjust the volume of the simulated drum set.

The DEMO sensor is used to play a "demo" of the current song selection within the constraints of the selected operating mode. For example, DEMO may have no effect in Freestyle Mode (modes described in more detail below). In Karaoke mode, DEMO may play the music using only the enabled music or song tracks. In Rhythm or Perfect Play Mode, DEMO may play all music or song tracks. Touching DEMO a second time may end the "demo" playback.

FIGS. 18A and 18B illustrate a printed circuit board (PCB) bus connection 388 included in the simulated drum set. In one embodiment, each of the capacitive touch sensors electrically couple to PCB bus connection 388 with conductive traces 390. The conductive traces 390 may be printed with conductive ink, for example as the capacitive touch sensors themselves may be printed. More specifically, the PCB bus connection 388 may be printed on the same surface and/or layer as the one or more capacitive touch sensors. Alternately or additionally, a portion of the PCB bus connection 388 may be printed on a separate surface and/or layer from at least one of the capacitive touch sensors. The PCB bus connection 388 area may also electrically couple to, for example, an electronics package and/or PCB (not illustrated) that may contain a microprocessor, memory, and/or any other electronic devices to detect and process input signals from the instrument sensors 376 or control sensors 386. The PCB bus connection 388 may couple to the electronics package with, for example, a flexible connection (e.g., flex circuit) or any other connection known in the art to electrically couple circuits and/or PCBs together.

The basic functionality of the instrument sensors 376 is to detect a finger tap much like a real drum or cymbal being hit with drumsticks. The finger tap may then trigger an audio output. As will be described more fully below, the audio output triggered by the drum sensor implementation may depend on one of three audio output/playback modes. The three modes include a Freestyle Mode, a Rhythm mode, and a Perfect Play mode. Two of these modes (e.g., Freestyle and Rhythm) cause the actual playback of sampled and/or pre-recorded audio of drum or cymbal sounds. The other mode (Perfect Play) may enable the playback of an audio track with pre-recorded music. Accordingly, the simulated drum set may produce a different audio output depending on both the mode and the specific triggering of the one or more instrument sensors 376.

Figure 19:
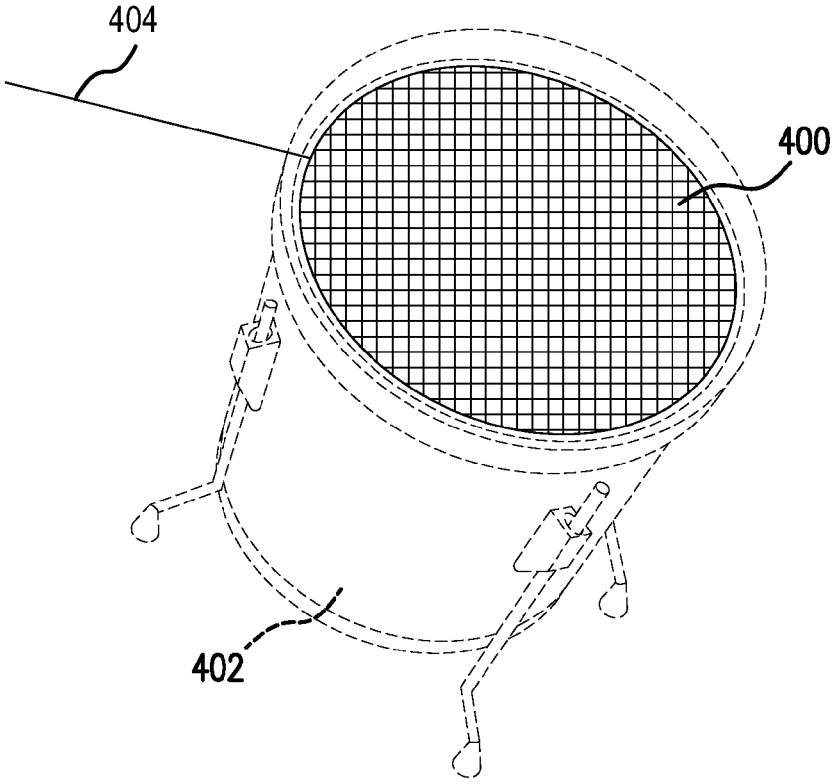
FIG. 19 illustrates a single capacitive touch sensor and associated artwork depicting a single drum.

FIG. 19 illustrates a single capacitive touch sensor and associated artwork depicting a single drum. More specifically, FIG. 19 illustrates a single drum sensor 400 covering at least a substantial portion of the top/batter head of a drum artwork 402. The single drum sensor 400 has a conductive trace 404. Alternately a single cymbal sensor would cover at least a substantial portion of the active area of the artwork cymbal (e.g. the surface or a combination of bell and bow). Touching or tapping the single sensor anywhere on the sensor will have the same effect (i.e., the same audio output). In an embodiment, this type of sensor may simplify the design of the simulated drum set sensors and/or may be used to represent drums and/or cymbals that have approximately uniform audio output characteristics regardless of where they are struck or otherwise played. The single drum or cymbal sensors may accordingly relate to fewer audio samples for the given drum or cymbal.

Figure 20:
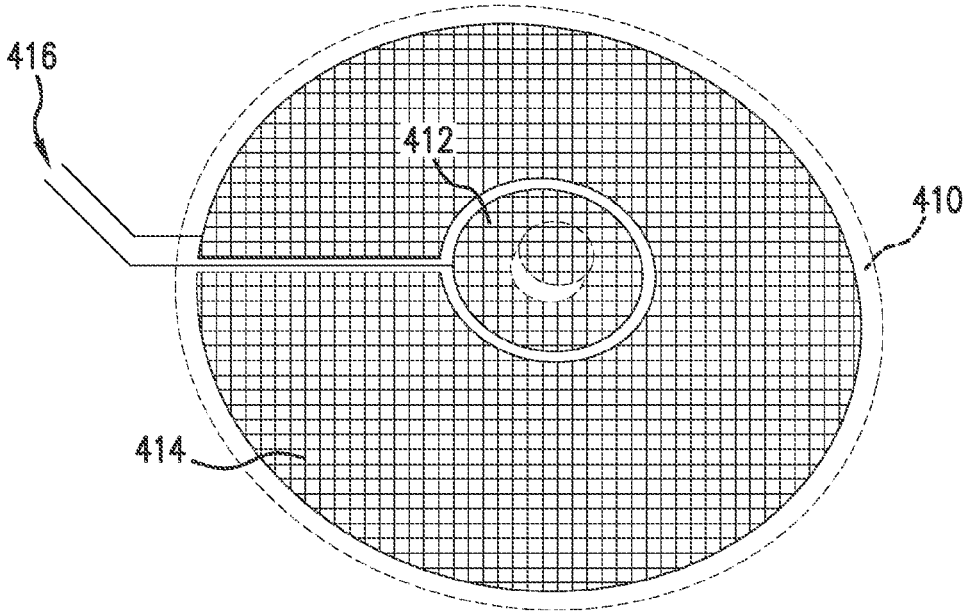
FIG. 20 illustrates an instrument sensor comprising a group of capacitive touch sensors and artwork depicting a single cymbal associated with the instrument sensor.
Figure 21:
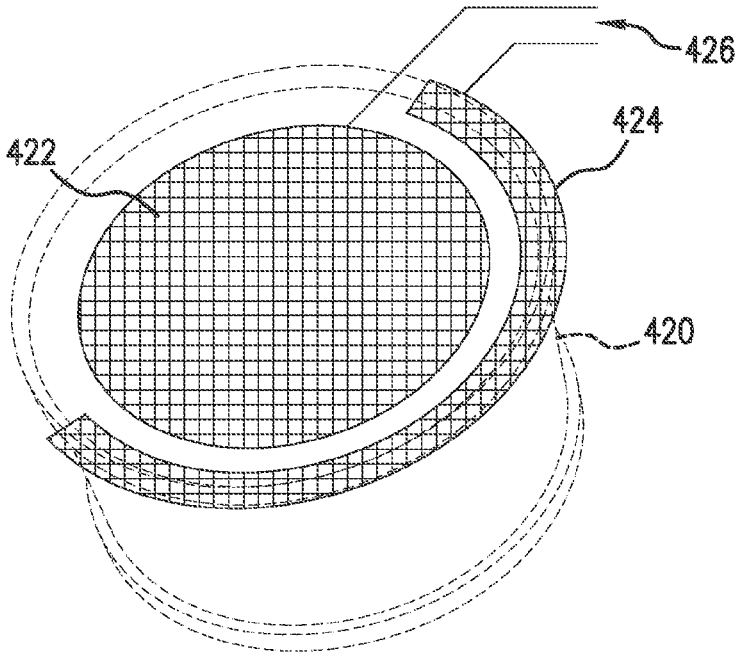
FIG. 21 illustrates an instrument sensor comprising a group of capacitive touch sensors and artwork depicting a single drum associated with the instrument sensor.

FIGS. 20 and 21 illustrate an alternate sensor configuration by which an instrument sensor related to a single artwork instrument (e.g. drum, cymbal) may include multiple capacitive touch sensors. Many drums and/or cymbals will make a different sound when they are struck or otherwise played at different areas. More specifically, many drums and/or cymbals will make a different sound if they are struck or otherwise played closer to or further away from their center. Accordingly, the simulated drum set may employ two or more sensors per drum or cymbal to approximately emulate that behavior.

FIG. 20 illustrates an instrument sensor comprising a group of capacitive touch sensors and artwork depicting a single cymbal associated with the instrument sensor. This embodiment has artwork of a ride cymbal 410. A real ride cymbal has a bell in the center that makes a distinctly different sound than its outer flat surface or bow. Accordingly, this embodiment has instrument sensor associated with the artwork of the ride cymbal 410 comprising a first capacitive touch sensor for the bell region (cymbal bell sensor 412) and a second capacitive touch sensor for the bow region (cymbal bow sensor 414). Both the cymbal bell sensor 412 and the cymbal bow sensor 414 each have their own conductive trace 416. With multiple sensors, each representing a different area of a single cymbal, the simulated drum set may more accurately emulate the sound produced by a real ride cymbal by playing different audio recordings for each sensor.

FIG. 21 illustrates an instrument sensor comprising a group of capacitive touch sensors and artwork depicting a single drum associated with the instrument sensor. Real drums may be played on the head, the rim, or on the side. This is done most typically with snare drums. To emulate a behavior of a particular drum where there is a clear physical feature that creates a sound change, the drum of an embodiment may employ multiple capacitive touch sensors representative of the multiple areas on which the drum may be played. For example, the simulated snare drum illustrated by FIG. 21 has a snared drum artwork 420 over a first capacitive touch sensor for the drum head (drum head sensor 422) and a second capacitive touch sensor for the rim (rim shot sensor 424). The simulated drum set is configured to play a drum head audio output when the drum head sensor 422 is triggered and configured to play a rim shot audio output when the rim shot sensor 424 is triggered. The rim shot sensor 424 may be configured as an outer ring concentric with the drum head sensor 422. Alternately, the rim shot sensor may be configured as at least an outer arc concentric with the drum head sensor.

In other embodiments, a single simulated drum or cymbal may have more than two sensors, adding more granularity in the sound produced by a simulated drum. Some drum and cymbal designs may continuously change tone or other characteristics based on the distance played from the center. A good example is bongo/conga drums as they produce distinctly different sounds when struck in the middle or closer to the edge. In particular, the sound may include a constant change from the center of the drums to their edges. Similarly, a ride cymbal may produce distinctly different sounds depending on where it is struck. For such a drum or cymbal, multiple capacitive touch sensors distributed about the drum or symbol may allow the emulation of multiple distinctive sounds. For example, a multiple sensor design/configuration of an embodiment may include multiple interleaved sensor rings to emulate this behavior. More specifically, multiple interleaved concentric capacitive touch sensor rings may be used to detect the specific areas of the drum or cymbal that was struck or played. By extension, multiple concentric capacitive touch sensor rings at multiple radii of the cymbal surface may each trigger the generation of a different audio output sample to approximate the taper and bow/curvature of the cymbal. Similarly, multiple concentric capacitive touch sensor rings at multiple radii of the bongo or conga drum head surface may each trigger the generation of a different audio output sample to approximate the elaborate sounds produced by various areas of each drum.

Figure 22:
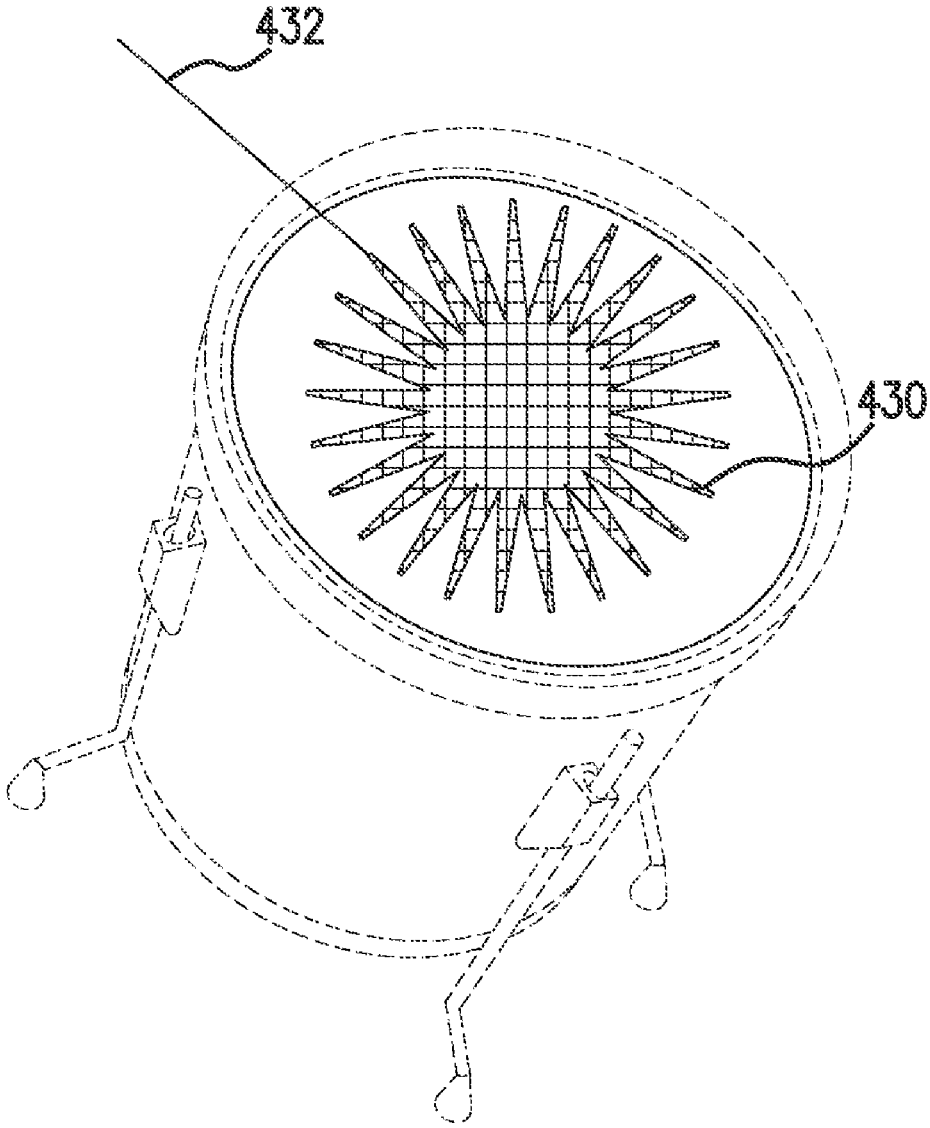
FIG. 22 illustrates a star-shaped capacitive touch sensor and associated artwork depicting a drum.

In some embodiments of simulated percussion instruments, individual capacitive touch sensors may have various shapes given the relative ease with which the conductive ink of the touch sensors may be printed (e.g., screen printed) in complex shapes. For example, FIG. 22 illustrates a star-shaped capacitive touch sensor 430 for in an embodiment of a simulated drum. The star-shaped capacitive touch sensor 430 is electrically connected to a conductive trace 432 to facilitate connection with an electronics package. Touches closer to the center of the star-shaped capacitive touch sensor 430 will create a greater change in capacitance than will touches near star finger ends. A simulated percussion instrument with such a sensor arrangement can select an audio output recording to play, and/or modify the audio output recording, based on the degree of capacitance change. Thus the audio output will be different based on how close to its center the star-shaped capacitive touch sensor 430 is touched.

Figure 23:
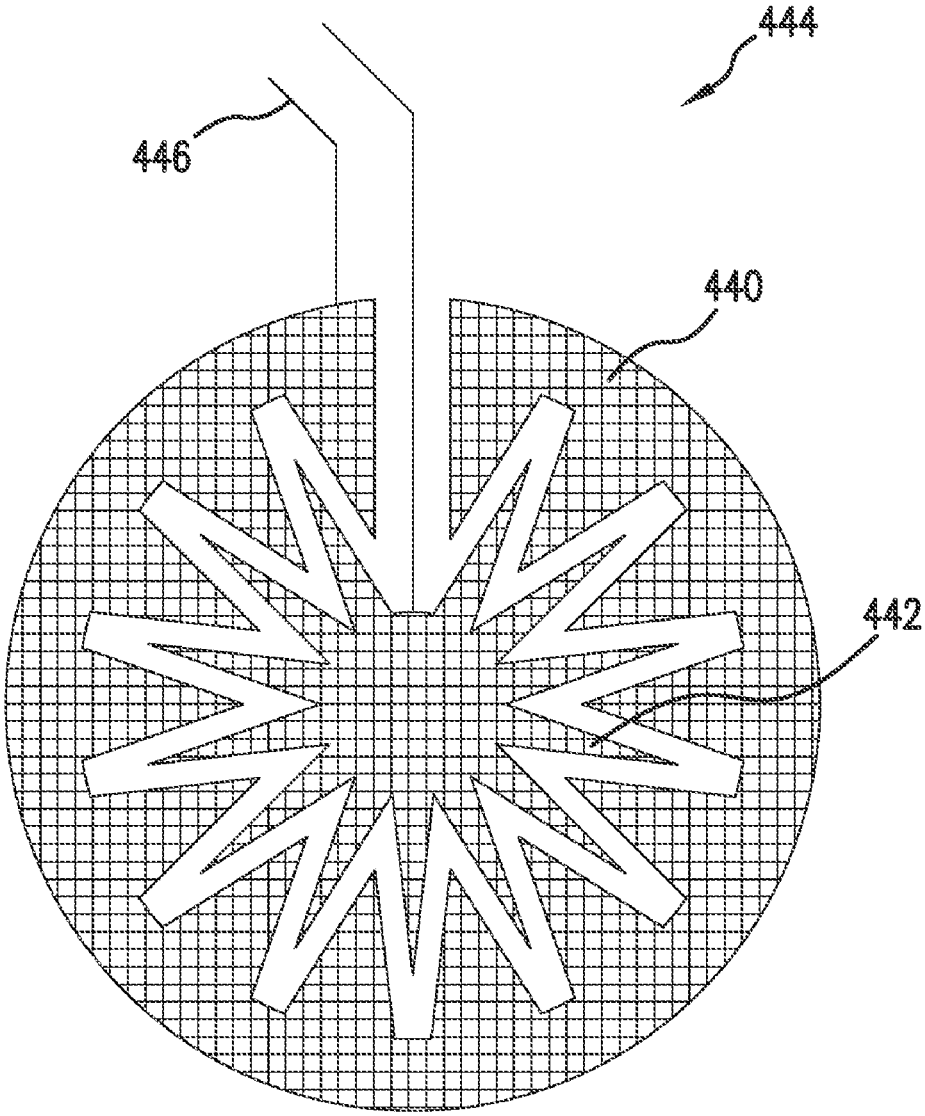
FIG. 23 shows an interdigitation pattern sensor comprising a group of capacitive touch sensors arranged in an interdigitation pattern.

FIG. 23 shows an interdigitation pattern sensor 444 comprising a group of capacitive touch sensors arranged in an interdigitation pattern. In this embodiment, the interdigitation pattern sensor 444 comprises an interdigited center sensor 442 surrounded by an interdigited ring sensor 440, with fingers of each combining to form the interdigitation pattern. More specifically, the interdigited center sensor 442 with its fingers originating as relatively thick and then becoming thin and pointed at the end may create a proportional response in the interdigitated region. Touching close to the base of the fingers of the interdigited center sensor 442 may create a larger proportional change in capacitance than in the interdigitated ring sensor 440 with its finger tips also in the same region. Likewise, touching in the middle between the two interdigitated sensors may yield a change in capacitance in both sensors that is proportionally close or equivalent. A simulated percussion instrument with such a sensor arrangement can select an audio output recording to play, and/or modify the audio output recording, based on the portion of capacitance change between the two sensors. Thus the audio output will be different based on where a touch occurs within the interdigitated region. In other embodiments, the interdigitation pattern sensor 444 may have more than two capacitive touch sensors arranged in an interdigitation pattern.

In other embodiments, the interdigitated region does not use star-shaped fingers, but fingers shaped more like a square wave. Touching anywhere in this square wave interdigitated region may yield an equivalent signal for both sensors.

Other multiple sensor configurations may be employed to more accurately emulate the variable sounds of percussion instruments. For example, a multiple sensor configuration representing a steel drum may include multiple capacitive touch sensors having multiple sizes, shapes, and locations to emulate the multiple facets of the steel drum face. The embodiments are not limited in this context.

Some embodiments of the simulated drum set may operate in various modes that exhibit different operational characteristics. For example, changing modes may alter the audio output, alter the difficulty level, and/or alter the creative freedom permitted. For example, some embodiments of the simulated drum set include a "Rhythm" mode, "Freestyle" mode, and a "Perfect Play" mode. Each operating mode will be discussed in turn.

In the Rhythm and Freestyle modes, tapping sensors associated with drums, cymbals, and/or pedals artwork causes playback of pre-recorded percussion instrument sounds. In Freestyle mode, the simulated drum set operates as a solo instrument with no background music, offering the user great flexibility in timing and selection of various percussion instrument sounds. Simply stated, Freestyle mode allows the user to play the simulated drum set as though they were a real drum set. For example, each of the drum and cymbal sensors triggers the output of its own assigned audio sample when tapped. In some embodiments of the simulated drum set, there are also multiple sound sample kits. Sound sample kits are collections of different drum and cymbal sounds that can be chosen (e.g., by triggering a mode or control sensor) to map a different set of drum and cymbal sounds to the sensors. For example, some embodiments may include three built-in sound sample kits to alter the drum and cymbal sounds. Accordingly, while the simulated drum set artwork may not change, the user may have some flexibility to alter the sounds generated by the simulated drum set.

In Rhythm Mode, some embodiments of the simulated drum set behave much like Freestyle Mode. Touching drums and cymbals sensors will still play the associated audio sample. However, in Rhythm mode the simulated drum set is configured to also play a background track superimposed with the user triggered drum and cymbal audio samples. The background track comprises sounds of other instruments, such as guitars, and/or vocal sounds. Each background track relates to a song. One or more background tracks are in the simulated drum set. The user can switch background tracks using one or more of the control sensors. Further, any of the sound sample kits can be used in Rhythm mode. In an embodiment, the sound sample kit may even be switched at any point during song playback.

For both Freestyle mode and Rhythm mode, some embodiments of the simulated drum set are capable of playing multiple sounds simultaneously. However, the number of sounds that may be played simultaneously may not be unlimited. A hardware and/or software algorithm may select and control multiple audio channels to play multiple sounds simultaneously. For example, each time a drum, cymbal, or pedal sensor is touched in Freestyle Mode, the simulated drum set plays the associated audio sound sample if one of the audio channels is available. If all audio channels are already actively playing a sound, one of the sounds must be stopped to release an audio channel to play the new sound. In some embodiments, to accurately simulate the of playing actual drums, multiple instances of a particular drum or cymbal audio sample may be played on more than one audio channel if more than one audio channel is available. The maximum number of instances that may be simultaneously played may be set individually for each audio sample (e.g., depending on how many audio channels may be desirable to accurately reproduce the sound of the drum or cymbal). This is taken into account by the hardware and/or software algorithm (e.g., the "audio playback engine" or simply the "audio engine") to select and control the multiple audio channels. In some embodiments, an audio channel for a new instance of an audio sample is chosen using the following procedure:

1. Determine the number of audio channels on which the audio sample is already playing. If a maximum number of instances for the audio sample is already playing (e.g., as predetermined for the corresponding drum or cymbal), stop playing the instance of the audio sample on the one channel having the least amount of time left to play so that audio channel becomes available to play the new instance of the audio sample.

2. If the maximum number of instances is not already playing, choose a new audio channel on which to play the new instance of the audio sample:

a. If any audio channels are not playing any audio samples, use one of these channels. The audio channel selected among these is arbitrary.

b. If all audio channels are playing audio samples, use the channel with the least amount of time left to play on its audio sample.

When terminating play of one audio sample instance in order to play a new instance of the same or different audio sample, it may be desirable to stop the audio sample with the least amount of time left to play, rather than stopping the sample that has been playing the longest. This will usually produce a more pleasing effect. For example, audio samples used for cymbals may be much longer than those used for a snare drum. However, stopping the snare drum sample in the middle (which may have only been playing for a short time) may be much less noticeable than stopping a cymbal sound in the middle because the user expects much more sustain (e.g., longer sound generation/playback) from a cymbal than a snare drum.

Rhythm Mode may employ a similar method to select an audio channel for the playback of an audio sample. In contrast to Freestyle mode, one or more of the available audio channels may be used for playback of background tracks associated with a song or music selection and would accordingly be unavailable to play other audio samples. For example, as the user plays the simulated drum set along with a song in Rhythm mode, three audio channels may be used to play a vocal track, a guitar track, and a general background track for that song. Those three channels would not be available for the playback of audio samples generated by the user tapping or otherwise triggering various drums and cymbal sensors.

In some embodiments, in addition to the Freestyle and Rhythm modes, a user may select the Perfect Play mode. In this mode, the simulated drum set may play a song's background tracks (e.g. vocal, guitar, and general background tracks) while the user's actions control playback of a main instrumental track (e.g., the drum track) for that song. Perfect Play is the easiest mode as tapping/hitting drums, cymbals, and/or pedals enables playback of the main instrument track. In one embodiment, the playback of the main instrumental track may not depend on which drum, cymbal, and/or other pedal in particular is tapped or otherwise triggered. Playback of the main instrumental track stops after a short time if the user stops drumming (e.g., tapping/hitting the drums, cymbals, and/or pedals).

To enable the Perfect Play mode, the audio playback engine includes a key feature to properly align and play the multiple audio channels so that the song, including playback of the main instrumental track, sounds appropriate. In particular, the audio playback engine employs "phrase markers" to properly align and play the multiple audio channels. More specifically, each song has associated data that may include a table of phrase markers that indicate times at which playback of the main instrumental track should be muted if the user has stopped playing. The table of phrase markers for each song stored for playback by the simulated drum set may be compiled manually based on the song's drum track and reflects points at which a musician would actually play/not play during the song. The compiled table of phrase markers allows the simulated drum set to have predefined musical phrases for the music's drum part during each song playback. Accordingly, the audio engine may use the phrase markers to control the playback of the main instrumental track in response to the input (or lack of input) from the user. For example, the audio engine may respond to the phrase markers to prevent the playback of the main instrumental track during predetermined portions of the song regardless of the input from the user. Further, the audio engine may respond to the phrase markers to prevent the playback of the main instrumental track from muting in the middle of such phrases (e.g., once the playback has been triggered by the user).

In some embodiments, the audio engine may use phrase markers with time units of audio samples. Accordingly, the phrase markers may be compiled based on the final sampling rate of the song. In some embodiments, the phrase markers may use time units of seconds (or milliseconds) or measures and beats. Further, in some embodiments, phrase markers may be stored as time delays relative to the previous phrase marker; however, an alternate embodiment may use an absolute time format. The use of relative or absolute times may be independent of the type of time unit.

When audio playback of stored tracks of a song reaches a phrase marker, the simulated drum set's firmware may mute the drum track if the user has not played for a certain period of time, for example by tapping a drum, cymbal, and/or pedal. The time period may be ½ second in some embodiments, but may be easily changed and could be different for each song. If the user has played within the required period, the drum track will continue playing at least until the next phrase marker is reached. If the user plays while the drum track is muted, it will be immediately un-muted without waiting until a phrase marker is reached. Each time the user plays, the time is stored or a timer is reset so that the time since the last play event can be checked when a phrase marker is reached. In some embodiments, playback of the drum track may continue internally while it is muted so that it remains synchronized with playback of the song's other tracks. Accordingly, by playing the simulated drum set, for example by tapping a drum, cymbal, and/or pedal, the user may effectively play the correct drum sound or sounds at the correct time for the song. Even if the user's play timing is only approximate, the Perfect Play mode may substantially ensure that the drum track matches the song being played.

In addition the various features of the Perfect Play mode described above, the embodiments of the simulated drum set may include any number of possible additional variations. For example, the user may select alternate main instrument tracks (e.g., by selecting different sound sample kits and/or other selection methods), control volume of main instrument track by changing speed of play or by physical orientation of the simulated drum set, and/or introduce additional user-triggered effects to main instrument track.

In some embodiments, when in Perfect Play or Rhythm modes, the user starts playback of a song (i.e., playback of the associated audio tracks for the song) by playing the simulated drum set, for example by tapping or otherwise touching a drum, cymbal, or pedal. Alternately or additionally, the simulated drum set may include different means of starting a song beyond the primary instrument play function (e.g., by tapping or otherwise touching a drum, cymbal, or pedal). The simulated drum set or other similarly fabricated instrument may start a song playback by the user utilizing a separate touch sensor or other trigger. The separate touch sensor or other trigger may start the song in lieu of or addition to starting to play the simulated drum set. In some embodiments, starting song playback will often be accomplished using capacitive touch sensors or other controls already present in the instrument. This may save cost and reduces complexity of the instrument. Generally speaking, the method of starting the song may be selected on an instrument-by-instrument basis so as to be easy to use and logical.

Once the song playback has been triggered as introduced above, the simulated drum set of an embodiment or any other instrument may play a count-in prior to the beginning of a song. The count-in, akin to the same for live play of real instruments, may inform the user of the selected playback song's tempo and gives him or her time to prepare. The count-in may typically be two measures, but can vary from song-to-song as appropriate.

The count-in may further aid multiple users playing multiple instruments to play a selected song together. Regardless of the method of starting the song and the particular instrument or multiple instruments playing the song, all embodiments of instruments that include the same song (i.e. have the sound tracks and data associated with the song) can be played together, particularly if the songs (i.e. the sound tracks) are the same length and edited identically. Further, the count-ins may have the same length. As starting a song on any instrument may require only a single action such as touching a strum sensor on a guitar or tapping drum sensor, it may be easy to start the same song on multiple instruments for group play.

Additional features may facilitate the synchronization of song playback across multiple instruments. For example, all but the main track (e.g., the track representing the instrument being played) may be muted on one or more instruments such that only a few or one instrument plays the other song track(s) (e.g. general background track, vocal track) to facilitate easier song synchronization. In such a case, additional tracks representing the instruments being played in the group may be muted. For example, for an instrument group including a simulated drum set and simulated guitar, the other song track(s) may be played only by the simulated drum set and may be muted by the simulated guitar. Further, so that the guitar sound is generated only by the simulated guitar actually being played by a user, the song track(s) played by the simulated drum set may further omit the guitar track. Additional or alternate synchronization methods may include wired or wireless coupling among the multiple instruments.

In some embodiments, alternate functions are available. In some embodiments, there are three types of alternate functions: selection of main operating mode (Rhythm, Perfect Play, or Freestyle); selection of sound sample kits (sound sample sets) for Rhythm or Freestyle modes; and muting and un-muting tracks for Karaoke mode. Alternative function may be accessed by touching control sensors or a combination of control sensors and instrument sensors. Instrument sensors may be assigned one or more alternate functions, which are accessed by triggering the instrument sensor and a mode modifier touch sensor. In the embodiment shown in FIG. 18B, one or more of the control sensors 386 may be a mode modifier sensor. For example, the user may first touch and release the mode modifier sensor and then one or more instrument sensors that double as alternate mode sensors. Additionally or alternately, the user can touch and hold the mode modifier sensor and then make multiple selections with multiple instrument sensors. The ability to make multiple selections quickly may be useful when muting or re-enabling several song audio tracks or to change modes quickly in order to review the songs available. For instrument embodiments that include a set of instrument sensors in linear arrangement (e.g. xylophone) the alternate functions may also include volume or other alternate functions that would benefit from and/or that logically correlate to a linear arrangement of sensors.

In some embodiments, the alternate functions may be accessed through the use of a mode modifier sensor, in combination with one or more other control sensor such as volume up or down.

In some embodiments, the simulated drum set may have the ability to selectively mute or play different tracks of songs. For example, the instrument may split songs into two tracks, one track for the main instrument (such as the drum track), and another track for everything else. This allows the instrument to play the background music and adjust the volume level (mute/unmute) of the instrument track.

In an alternate embodiment, the music or song may be split into more than two instrument tracks. For example, an embodiment may use four tracks per song to typically represent the guitar, drums, vocals, and other music. The actual number of tracks and the instruments assigned to each track may vary with the particular songs. The simulated drum set may include an interface or one or more controls for muting and un-muting (or in some embodiments, controlling the volume of) the various music or song tracks individually and/or in combination. In some implementations, the interface or one or more controls may allow the user to select which music or song tracks are to be played when starting the song. In other implementations, the interface or one or more controls may allow the user to adjust track selection while the song is playing. One result of the selective muting of any vocal tracks is a Karaoke mode for which the user can themselves provide accompanying vocals.

Invoking or selecting the Karaoke mode may be performed in several ways, depending on the embodiment. For example, with a Perfect Play or Rhythm mode selected, the user may touch the mode and volume down control sensors together to toggle a track state (mute or un-mute) of a subsequently selected music or song track. For a particular song, the user may select which track to mute or un-mute by touching the drum instrument sensor assigned to the particular desired track (e.g. vocals, guitar, and other background music).

Karaoke mode may expand the play possibilities of the simulated drum set. Akin to karaoke as generally understood, the user may mute the vocal track so they may sing along with the songs. A user or solo player can also mute various other tracks to achieve interesting variations in the songs. In some embodiments, the main instrument track may not be muted. However it may be possible to effectively mute this track by simply doing nothing (i.e., not playing the instrument) while the song is playing in either Perfect Play or Rhythm mode.

Karaoke mode may also improve ensemble play by allowing different instruments to be used together more effectively. Take the example of three users having simulated guitar, drum set, and microphone respectively. The guitar player may mute the drum and vocal tracks, the drum player may mute the guitar and vocal tracks, and the microphone user may mute the guitar and drum tracks. This makes using the instruments together much more like playing in an ensemble. If desired, the remaining background music track could be enabled on only one of the three users' instruments as described above to mitigate synchronization issues.

In some embodiments, some of the instrument sensors are pedal sensors, located beneath artwork of drum set pedals. For example, the simulated drum set may include three drum set pedals, one simulating a hi-hat cymbal and two for simulating a bass drum (commonly known as double bass pedals). These pedal sensors are implemented to behave substantially similar to the pedals on physical drum sets. For example, when a bass drum pedal sensor is tapped or otherwise triggered, a bass drum sound track is played. The two bass drum pedals of an embodiment may behave independently to allow the user to rapidly play bass drum sounds.

The simulated drum set may include a hi-hat sensor and a hi-hat pedal sensor. A real hi-hat includes two cymbals that are mounted on a stand, one on top of the other, that may be clashed together using a pedal coupled to the stand. A narrow metal shaft or rod may run through a hollow tube through both cymbals and may connect to the pedal. The top cymbal may be connected to the shaft or rod with a clutch, while the bottom cymbal remains stationary resting on the hollow tube. When the pedal is pressed, the top cymbal crashes onto the bottom cymbal (closed hi-hat position). When released, the top cymbal returns to its original position above the bottom cymbal (open hi-hat position). When the hi-hat cymbal is struck with a drum stick it has a distinct sound when open compared to when closed. Touching and releasing the hi-hat pedal sensor causes the simulated drum set to play a muffled hi-hat cymbal sound. If the hi-hat pedal sensor is touched and held, hitting the hi-hat sensor will cause the simulated drum set to play a closed hi-hat sound. If the hi-hat pedal is released (or not touched), tapping the hi-hat sensor will cause the simulated drum set to play an open hi-hat sound. Tapping the hi-hat cymbal sensor in this state will play a cymbal sound with a longer sustain.

In some embodiments, the pedal sensors may trigger or otherwise implement additional or alternate behaviors. For example, one of the bass pedal sensors may be used to play a multiple strike sound with one touch to the pedal. The rate of the multiple strikes may be adjusted to be appropriate for the current music's tempo. Further, a pedal sensor could be mapped to any other drum or cymbal on the simulated drum set selected by the user. Further still, the hi-hat pedal sensor could act like a toggle switch. Each time the hi-hat pedal is touched it could change the state between open and closed. This effective shortcut may free up fingers for other activities during while playing.

Some embodiments of the simulated drum set may also include a hardware port to which external physical pedals may be connected. The hardware port may further support the connection of two pedals (e.g., the two pedals may daisy-chain together). For such an embodiment, one pedal may be mapped to the bass drum and the other pedal mapped to the hi-hat. The physical pedals may operate in addition to and/or in lieu of the virtual pedals. Similar to the virtual pedals, the physical pedals may be configured to trigger or otherwise implement additional or alternate behaviors as described above.

In addition to the functionality described above, some embodiments of the simulated drum set may include a looping feature or capability. For example, the addition of one or more sensors may allow the user to record a series of drum events for approximately 8 beats (2 measures) and then may give the user the ability to "loop" that recording as a background track while playing over it. Some embodiments of the simulated drum set may also come with some pre-made and/or pre-recorded loops from which the user may choose. Some embodiments of the simulated drum set may further include drum fills. Drum fills may be pre-determined and/or pre-recorded musical drum phrases. The user may trigger a drum fill, which would be one of the pre-recorded phrases, by any variety of triggering. For example, the user may trigger a drum fill by playing a particular drum sequence. Alternately, the user may directly trigger the drum fill. Some embodiments of the simulated drum set may also allow the user to record custom drum fills. Both the loop and drum fill functionalities may be adjusted to different tempos (or in an embodiment mapped automatically) so they would work with different songs that may have differing tempos.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

We claim:

1. A simulated percussion instrument comprising:

a sensor layer with at least one instrument sensor, the instrument sensor comprising one or more capacitive touch sensors;

a shield layer adjacent the sensor layer to form a shielded side of the sensor layer; and an audio engine configured to play an audio output in response to triggering of the instrument sensor;

wherein the instrument sensor is an interdigitation pattern sensor with a plurality of capacitive touch sensors arranged in an interdigitation pattern.

2. The simulated percussion instrument of claim 1, the shield layer configured to substantially prevent triggering the instrument sensor from the shielded side of the sensor layer.

3. The simulated percussion instrument of claim 1, the shield layer further comprising one of: an air gap structure, a dielectric block, a conductive ground plane layer, or a combination thereof.

4. The simulated percussion instrument of claim 1, further comprising an art layer adjacent the sensor layer and opposite the shielded side of the sensor layer, the art layer including artwork representing a drum set.

5. The simulated percussion instrument of claim 4, wherein the art layer and the sensor layer are integrally formed on a shared substrate.

6. The simulated percussion instrument of claim 1, wherein the audio engine is configured to modify the audio output based on a distance from center of the instrument sensor at which a triggering event occurs.

7. The simulated percussion instrument of claim 1, wherein the instrument sensor is a star-shaped capacitive touch sensor.

8. The simulated percussion instrument of claim 7, wherein the audio engine is configured to modify the audio output based on a degree of capacitance when the star-shaped capacitive touch sensor is triggered.

9. The simulated percussion instrument of claim 1, wherein the audio engine is configured to modify the audio output based on a portion of capacitance change between the plurality of capacitive touch sensors when the interdigitation pattern sensor is triggered.

10. The simulated percussion instrument of claim 1, wherein the audio engine is configured to play one or more instances of one or more audio samples on a plurality of audio channels simultaneously.

11. The simulated percussion instrument of claim 10, wherein the audio engine is configured to, in response to a triggering event of the instrument sensor, play a new instance of an audio sample associated with the triggered instrument sensor.

12. The simulated percussion instrument of claim 11, wherein the audio engine is configured to, in response to a triggering event of the instrument sensor, play a new instance of an audio sample associated with the triggered instrument sensor by performing the steps of:

(a) determining if a number of instances of the audio sample already playing is less than a maximum number of instances;

if (a) is determined false, then (b) stopping play of the instance of the audio sample on the audio channel having a least amount of time left to play thereby making that audio channel available;

if (a) is determined true, then (c) determining if there is an available audio channel;

if (c) is determined not true, then stopping play of an instance of another audio sample on the audio channel having a least amount of time left to play thereby making that audio channel available; and (d) playing the new instance of the audio sample on an available channel.

13. The simulated percussion instrument of claim 11, wherein the audio engine is configured to play a one or more background tracks on a subset of the plurality audio channels.

14. The simulated percussion instrument of claim 13, wherein the audio engine is configured to mute, in response to a command to do so, one of the background tracks.

15. The simulated percussion instrument of claim 10, wherein the audio engine is configured to perform the steps of:

starting play of a main instrument track and one or more background tracks associated with a song on the audio channels in response to a first triggering event for one of the instrument sensors;

muting the main instrument track when reaching a phrase marker in the main instrument track if time since a last triggering event on one of the instrument sensors exceeds a set period; and unmuting the main instrument track in response to a new triggering event on one of the instrument sensors.

16. The simulated percussion instrument of claim 1, wherein the audio engine is configured to enter one of a plurality of modes, including a freestyle mode, rhythm mode or perfect play mode.

* * * * *